United States Patent [19]

Stuntz et al.

[11] Patent Number: 5,026,475

[45] Date of Patent: Jun. 25, 1991

[54] COAL HYDROCONVERSION PROCESS COMPRISING SOLVENT EXTRACTION (OP-3472)

[75] Inventors: Gordon F. Stuntz; Claude C. Culross; Steve D. Reynolds, all of Baton Rouge, La.

[73] Assignee: Exxon Research & Engineering Company, Florham Park, N.J.

[21] Appl. No.: 455,654

[22] Filed: Dec. 21, 1989

[51] Int. Cl.[5] ..... C10G 1/02; C10G 1/06

[52] U.S. Cl. ..... 208/403; 208/412; 208/413; 208/414; 208/419; 208/415; 208/420

[58] Field of Search ..... 208/424, 415, 414, 419, 208/421, 430, 433, 403, 412, 413, 420

[56] References Cited

U.S. PATENT DOCUMENTS

| | | | |
|---|---|---|---|
| 3,642,607 | 2/1972 | Seitzer | 208/433 |
| 3,808,119 | 4/1974 | Bull et al. | 208/433 |
| 4,028,220 | 6/1977 | Urguanart | 208/433 X |
| 4,092,235 | 5/1978 | Schlosberg | 208/419 |
| 4,119,523 | 10/1978 | Baldwin et al. | 208/424 |
| 4,324,643 | 4/1982 | Durai-Swamy | 208/414 X |
| 4,522,700 | 6/1985 | Scnindler | 208/424 |
| 4,728,418 | 3/1988 | Shabtai et al. | 208/413 |
| 4,737,261 | 4/1988 | Hoover . | |

*Primary Examiner*—Anthony McFarlane
*Attorney, Agent, or Firm*—Roy J. Ott

[57] ABSTRACT

An improved process for the hydroconversion of coal comprising pretreating coal in an aqueous carbon monoxide-containing environment, followed by extracting a soluble hydrocarbon material from the coal, and subsequently hydroconverting the extracted material in a hydroconversion reactor. The extracted material consists of a relatively hydrogen-rich material which is readily converted to valuable liquid products in high yield. The residue from the extraction stage is relatively hydrogen deficient material which can be gasified to produce hydrogen and carbon monoxide for the hydroconversion and pretreatment stages, respectively.

53 Claims, 5 Drawing Sheets

COAL HYDROCONVERSION PROCESS COMPRISING SOLVENT EXTRACTION (OP-3472)

The invention relates to a process for liquefying coal, in particular, a multi-stage process comprising in sequence a pretreatment stage, an extraction stage, and a catalytic hydroconversion stage.

BACKGROUND OF THE INVENTION

1. Field of the Invention

The petroleum industry has long been interested in the production of "synthetic" liquid fuels from non-petroleum solid fossil fuel sources. It is hoped that economic non-petroleum sources of liquid fuel will help the petroleum industry to meet growing energy requirements and decrease dependence on foreign supplies.

Coal is the most readily available and most abundant solid fossil fuel, others being tar sands and oil shale. The United States is particularly richly endowed with well distributed coal resources. Additionally, in the conversion of coal to synthetic fuels, it is possible to obtain liquid yields of about three to four barrels per ton of dry coal, or about four times the liquid yield/ton of other solid fossil fuels such as tar sands or shale, because these resources contain a much higher proportion of mineral matter.

Despite the continued interest and efforts of the petroleum industry in coal hydroconversion technology, further improvements are necessary before it can reach full economic status. Maximizing the yield of coal liquids is important to the economics of coal hydroconversion.

The present invention relates to an improved process for converting coal to liquid hydrocarbon products in a catalytic hydroconversion process. The improvement relates to a coal pretreatment stage comprising subjecting the coal to aqueous carbon monoxide under specific pressure and temperature conditions. Such pretreatment enhances solubility in the subsequent coal extraction stage. The reactivity of the coal extract in the subsequent hydroconversion stage is advantageously high.

2. Description of the Prior Art

The known processes for producing liquid fuels from coal can be grouped into four broad categories: direct hydrogenation, donor solvent hydrogenation, Fischer-Tropsch synthesis (via gasification), and pyrolysis (see Kirk Othmer - Fuels).

The direct hydrogenation of coal in the presence of solvent and catalyst was first developed in Germany prior to World War II. In such a process, a slurry of coal in a suitable solvent was reacted in the presence of molecular hydrogen at an elevated temperature and pressure.

A number of previous co-assigned patents disclose coal liquefaction processes utilizing hydroconversion catalysts which are micron-sized particles comprised of a metal sulfide in a carbonaceous matrix. These catalysts are generally formed from certain soluble or highly dispersed organometallic or inorganic compounds or precursors. These precursors are converted into catalyst particles by heating in the presence of a hydrogen-containing gas. The catalyst particles are highly dispersed in the feed being treated during hydroconversion. Among the various patents in this area are U.S. Pat. No. 4,077,867; U.S. Pat. No. 4,094,765; U.S. Pat. No. 4,149,959; U.S. Pat. No. 4,298,454; and U.S. Pat. No. 4,793,916. Other patents disclose catalysts similar to the above except that the catalytically active metal compound is supported on finely divided particles of solid metals and metal alloys, for example as disclosed in U.S. Pat. Nos. 4,295,995 and 4,357,229.

The conversion of coal in the presence of high temperature steam and carbon monoxide is well known, dating back to Fischer and Schrader in 1921 (F. Fisher & H. Schrader, Bennst. Chem., 2, 257, 1921). Several hydroconversion processes, including the U.S. Bureau of Mines COSTEAM process (H. R. Appell, E. C. Moroni, R. D. Miller, Energy Sources, 3, 163, 1971), have been developed based on using steam/carbon monoxide or steam/syngas at 750–850° F. in a primary conversion step. In contrast, the present invention is directed to the use of an aqueous carbon monoxide environment for pretreatment of coal before a subsequent primary conversion step.

One of the problems encountered in certain catalyzed coal hydroconversion processes is the separation of slurried catalyst from solid by-products, such as undissolved organic coal and ash. Such solid materials are typically dispersed throughout the reaction mixture during the hydroconversion operation, and are thus present in the coal liquid recovered after hydroconversion. Such solid materials are present in the coal liquids in a finely divided, particulate state, and are typically separated from the coal liquid products by distillation.

Another problem inherent in coal hydroconversion processes has been the requirement for large amounts of hydrogen. It has been suggested that this problem of hydrogen consumption could be reduced by converting only a relatively small fraction of the coal, which fraction is rich in hydrogen. However, to be economical, there is a need for a process which converts a relatively large fraction of the coal to valuable liquid hydrocarbon products. The present process, while not necessarily reducing the requirement for hydrogen, allows coal to be taken to a higher conversion level. Hydrogen utilization is therefore more efficient. For a given amount of liquid products less gas is produced, resulting in a better liquid to gas selectivity.

An object of the present invention is to provide a novel process for the hydroconversion of coal in order to produce valuable liquid hydrocarbonaceous products.

A further object of the present invention is to provide an improved process for producing liquid hydrocarbonaceous products from coal by utilizing a pretreatment step wherein the coal is subjected to reaction with aqueous carbon monoxide.

A still further object of the present invention is to pretreat coal in a specific temperature range to enhance extraction and generate a more reactive coal material for hydroconversion, thereby obtaining more product, with better liquid to gas selectivity.

Another object of the present invention is to improve the utilization efficiency of molecular hydrogen, in the transformation of coal to valuable liquids, by sending a more hydrogenated fraction of the coal to hydroconversion, as well as effecting better liquid-to-gas selectivity.

Another object of the present invention is to increase the thermal efficiency of a coal hydroconversion plant by providing a more efficient coal dewatering and coal partial oxidation operation.

Still another object of the present invention is to liquefy coal by a process comprising in sequence a pretreatment stage, an extraction stage (ex-situ or in-situ), and a catalytic hydroconversion stage.

Additional advantages of the present coal hydroconversion process will become apparent in the following description.

SUMMARY OF THE INVENTION

In accordance with the present invention, there is provided a process for liquefying coal to produce an oil, comprising: (a) forming a mixture of coal, carbon monoxide and water in a pretreatment zone and subjecting the mixture to a temperature and pressure effective to cause hydrogenation and mild depolymerization of the coal; (b) removing gases and water from the coal mixture in a separation zone; (c) extracting the pretreated coal with an organic solvent in an extraction zone to obtain an extract comprising a substantial amount of soluble hydrocarbonaceous coal; (d) forming a subsequent mixture of said extract and a catalyst wherein the catalyst comprises a sulfided metal containing compound, said metal being selected from the group consisting of Groups VA, VIA, VIIA and VIIIA of the Periodic Table of Elements and mixtures thereof; and (e) reacting the mixture of coal extract and catalyst with hydrogen under coal hydroconversion conditions in a hydroconversion zone to obtain a hydrocarbonaceous liquid product.

In accordance with another embodiment of the invention, there is provided a process for liquefying coal to produce an oil, which comprises: (a) subjecting a mixture of coal, water and carbon monoxide to a temperature of 550° F. to 700° F. and a carbon monoxide partial pressure of 500 to 5000 psi for a period of at least 10 minutes, (b) removing gases and water from the coal mixture; (c) extracting the pretreated coal with an organic solvent in an extraction zone to obtain an extract comprising a substantial amount of soluble hydrocarbonaceous coal; (d) forming a subsequent mixture of said extract, an organic solvent, preferably coal derived, and a catalyst, wherein the catalyst comprises a sulfided metal compound and has an average particle size of 0.02 to 2 microns, preferably a conversion product of an organic oil-soluble metal containing compound, said metal being selected from the group consisting of Groups VA, VIA, VIIA and VIIIA of the Periodic Table of Elements and mixtures thereof; and (e) reacting the latter mixture with a gas comprising molecular hydrogen under coal hydroconversion conditions, in a hydroconversion zone to obtain a hydrocarbonaceous liquid product.

BRIEF DESCRIPTION OF DRAWINGS

The process of the invention will be more clearly understood upon reference to the detailed discussion below and upon reference to the drawings wherein.

DESCRIPTION OF THE PREFERRED EMBODIMENTS

Figure 1:
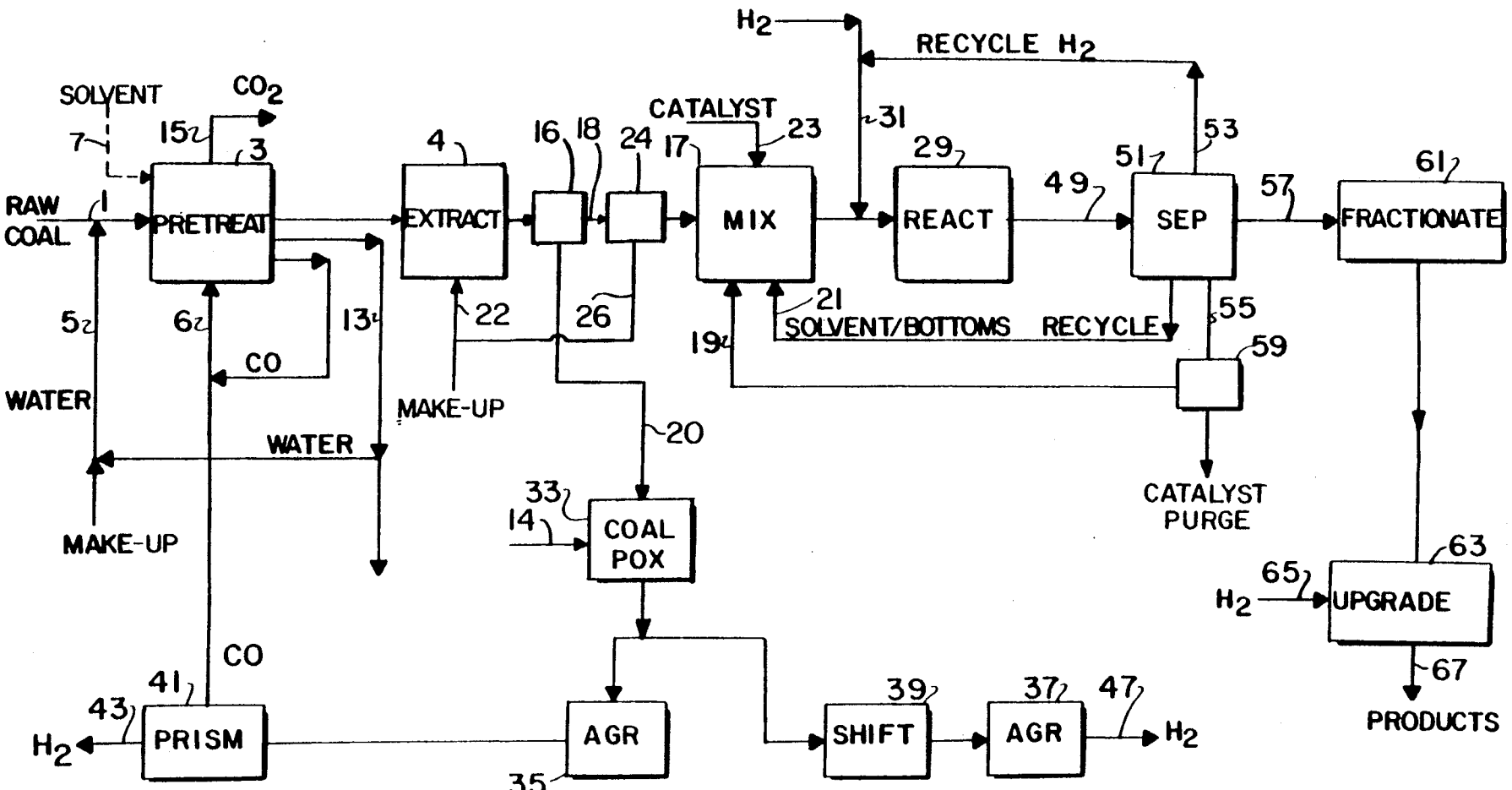
FIG. 1 shows a process flow diagram illustrating the subject invention wherein coal is pretreated in the presence of aqueous carbon monoxide and thereafter converted into valuable liquids.

The process of the invention is generally applicable to hydroconvert coal to coal liquids (i.e., an oil or normally liquid hydrocarbonaceous product). The process comprises a pretreatment stage, an extraction stage and a catalytic hydroconversion stage. In the pretreatment stage, a coal feed is pretreated with carbon monoxide (or a gaseous mixture such as syngas containing carbon monoxide) and water at an elevated temperature and pressure. In the extraction stage, the pretreated coal is extracted with an organic solvent, either in-situ or following pretreatment, to produce an essentially ash-free hydrocarbonaceous extract (typically less than 1% ash by weight) before further catalytic upgrading. Separation of this extract from the ash residue of the coal prior to further hydroconversion greatly facilitates catalyst recovery. Even weight % loadings of catalyst are permitted in the upgrading or hydroconversion zone, leading to an improved product state and product quality. Specifically, the present coal hydroconversion process is capable of providing a higher liquid to gas selectivity. The extraction stage also yields a hydrogen-enriched fraction requiring less hydrogen at constant conversion and produces a hydrogen lean, catalyst-free ash residue reject for partial oxidation or combustion. This residue contains less hydrogen per gram than the raw coal.

The term "coal" is used herein to designate a normally solid carbonaceous material including all ranks of coal below anthracite, such as bituminous coal, sub-bituminous coal, lignite, peat and mixtures thereof. The sub-bituminous and lower ranks of coal are particularly preferred.

The raw material for the present process is coal that has been first reduced to a particulate or comminuted form. The coal is suitably ground or pulverized in a conventional ball mill to provide particles of a size ranging from 10 microns up to about ¼ inch particle size diameter, typically about 8 mesh (Tyler).

Pretreatment

According to the process, a reedstock such as brown coal, lignite, sub-bituminous coal or bituminous coal is subjected to an aqueous carbon monoxide environment during pretreatment, so that solvent solubility is substantially increased by mild selective bond depolymerizing and hydrogenation. Generally, the more extensive the pretreatment, the better the solubility.

Coal is reacted in the pretreatment stage at relatively mild temperatures. A limited amount of volatile hydrocarbon liquids are produced during the pretreatment stage (typically less than about 10% by weight). However, the coal is hydrogenated and depolymerized, and the equilibrium moisture and oxygen levels are reduced. After such pretreatment, not only are the properties of the coal upgraded, but the coal shows enhanced reactivity for further processing. In particular, the pretreatment significantly increases the coal's value as feedstock for coal hydroconversion. The severity of the coal hydroconversion can be reduced while increasing liquid yields, reducing gas make, and lowering hydrogen consumption, although it is more economically favorable to maintain hydroconversion severity so as to maximize conversion. The coal can reach a significantly higher daf weight % (dry ash free weight %) conversion following pretreatment.

Unlike most hydroconversion systems, which are based on thermal/free radical chemistry, the aqueous chemistry of the present pretreatment stage is generally believed to operate through an ionic mechanism. Studies have indicated multiple independent reaction pathways in the pretreatment step, including a hydrogenation pathway which results in an increased H/C (hydrogen to carbon) ratio and increased volatile matter content. This pathway generates a soluble product and a more reactive coal. In this pathway, the mechanism which was proposed by H. R. Appell (H. R. Appell, R. D. Miller, R. G. Illig, R. C. Moroni, F. W. Steffgen, Report PETC/TR-79/1, 1979) is still widely accepted, wherein the active intermediate is a formate-type anion which is formed by catalytic amounts of base in the system, as follows:

$$CO + H_2O \longrightarrow HCO_2^- + H^+$$

$$HCO_2^- + [COAL] \longrightarrow [COAL]H^- + CO_2$$

$$[COAL]H^- + H_2O \longrightarrow [COAL]H_2 + OH^-$$

$$H^+ + OH^+ \longrightarrow H_2O$$

$$H_2O + CO + [COAL] \longrightarrow [COAL]H_2 + CO_2$$

Thus, donatable hydrogen is incorporated into the coal. For example, hydrogenation of ring systems in the coal matrix to form hydroaromatics is thought to be facilitated. Hydroaromatics comprise one class of compounds that can donate hydrogen to cap free radicals during hydroconversion and thus mitigate undesirable condensation reactions. The bonds adjacent to hydroaromatics are also not refractory.

Figure 4:
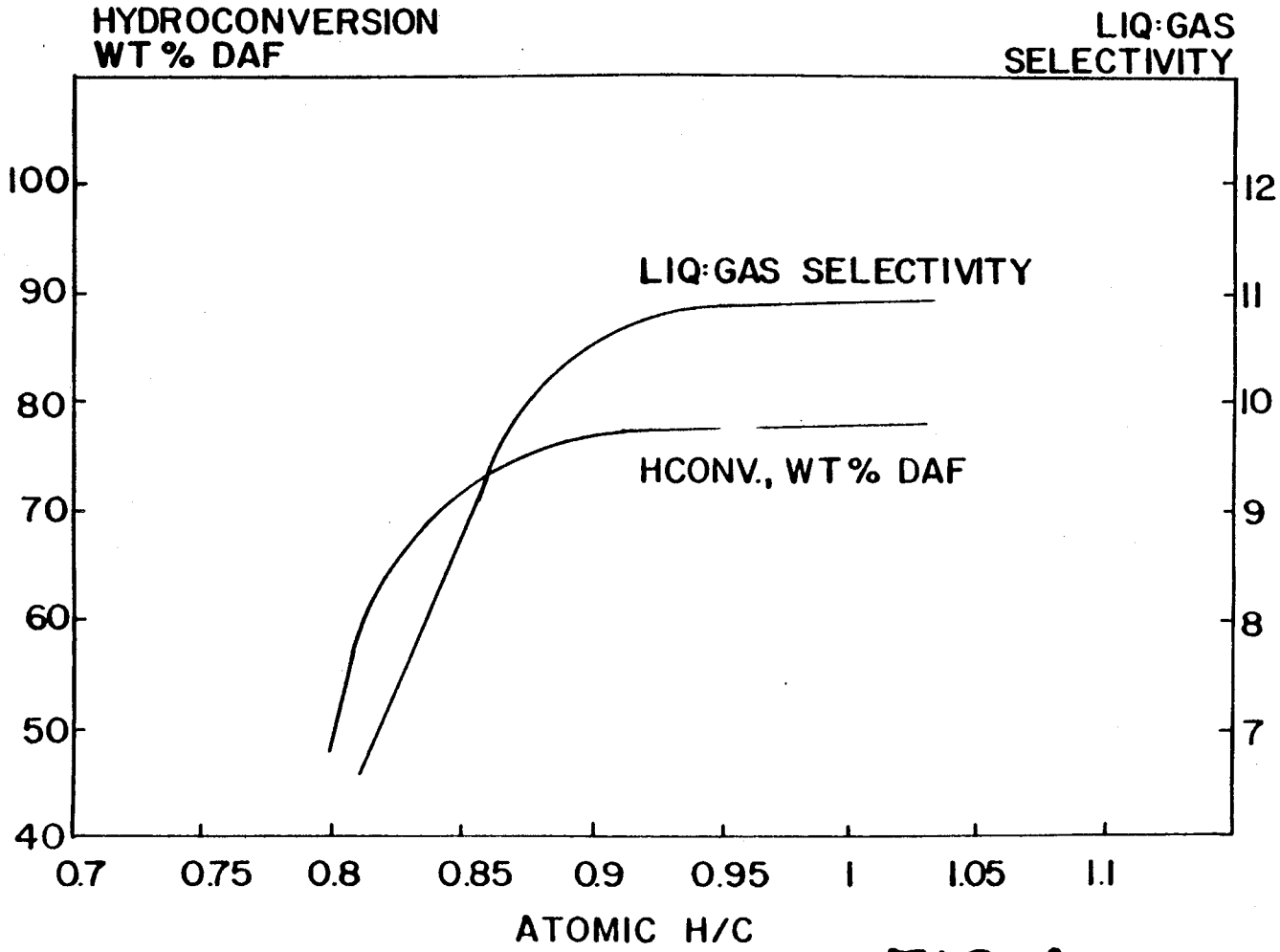
FIG. 4 is a graph showing the effect of a higher hydrogen to carbon ratio in a feed material on liquid to gas selectivity and hydroconversion.

The hydrogenation of coal during pretreatment appears to be a major factor responsible for its enhanced reactivity. This pretreatment has the effect of increasing the volatile matter content and hydrogen to carbon (H/C) atomic ratio of the coal. In general, as indicated by FIG. 4, increased H/C ratio corresponds to more highly reactive coals during subsequent hydroconversion. The pretreated coal behaves during subsequent coal hydroconversion like a higher rank coal with the same volatile matter content. For example, pretreatment in aqueous CO can make a lignite or subbituminous coal behave like a bituminous coal by reducing the water and oxygen levels and increasing volatile matter content prior to hydroconversion. This is economically quite significant since, for example, a Wyoming subbituminous coal may be only about 30% the cost of an Illinois bituminous coal, and a Victorian brown coal may only be about 20% the cost of an Illinois bituminous coal, on a dollar per MBTU basis.

In another reaction pathway occurring during coal pretreatment, coal depolymerization reactions occur. Depolymerization is detected by an increased solubility in various solvents. The solubility increase makes the subsequent extraction step possible. The increased solubility as a result of pretreatment may also enhance reactivity during hydroconversion. The role of the aqueous carbon monoxide pretreatment in depolymerizing coal is not well understood and has been the subject of some work in the literature. The ability to depolymerize coal has been variously attributed to bond breaking activity, or to the removal of potential cross link sources which cause condensation to higher molecular weight products following thermal bond rupture.

Much of the aqueous chemistry involved in aqueous carbon monoxide coal pretreatment is believed to occur at oxygen containing bonds, and its effect is especially evident with oxygen rich coals. The pre treatment promotes decarboxylation of the coal and there is evidence that it also promotes some ether and ester cleavage in the coal.

Pretreatment of coal according to the present invention is suitably carried out in a reactor of conventional construction and design capable of withstanding the hereafter described conditions of pretreatment. A stainless steel cylindrical vessel with inlet lines for the coal slurry and carbon monoxide and product removal lines is suitable.

The pretreatment process conditions can have a large impact on the results. For example, to optimize reactor configuration, it is desirable to minimize the "at conditions" (operating conditions) liquid water-to-dry coal weight ratio ("at conditions", as compared to "inlet conditions", excludes water evaporated to steam, and water lost via the water gas shift reaction). However, a weight ratio of liquid water-to-dry coal of at least about 0.5:1 is required. If the ratio is below this value, the product coal properties are poor. The preferred "at condition" is about 0.5:1 to 2:1, most preferably above 1:1. The preferred inlet ratio is about 1.25:1 to 4:1, most preferably 1.5:1 to 2:1 and at least 1:1. A portion of the required water is inherently present in coal; the remainder must be added.

In order to minimize the amount of water which will be heated up in the pretreatment reactor, it is desirable to feed the coal into the reactor at the minimum pumpable water/solid ratio, which is about 1.25/1 on a weight basis (while simultaneously maintaining at least 0.5:1 in the reactor) the limit for pumpability will be variable and dependent upon the physical properties of a given coal. Similarly, there are a number of incentives for minimizing the carbon monoxide treat rate in the pretreatment reactor, including reducing the amount of water which would be flashed during the separation step, and decreasing compression and gas cleanup requirements.

In a preferred embodiment of the pretreatment stage, an added organic solvent, immiscible or miscible with water, either added or built up during $H_2O$ recycle, is employed to enhance coal dispersion and flowability. An organic solvent helps prevent the pretreated coal from agglomerating and plugging vessels and lines in a continuous processing scheme. The ratio of organic solvent to coal is preferably about 0.25:1 to 2:1. Suitable organic solvents include, but are not limited to, alcohols such as isopropyl alcohol, ketones, phenols, carboxylic acids, and the like. Coal-derived liquids are also suitable. By-products of the pretreatment stage, concentrated and accumulated in a recycle water stream, are a good source for many of these organics.

The pretreatment temperature has a large impact on the quality of coal. A temperature within the range of 550 to 700° F. is critical, a temperature of 600 to 675° F. is preferred, and a temperature of 600 to 650° F. is most preferred.

Another important pretreatment process condition is carbon monoxide (CO) pressure and the amount fed relative to coal. Higher CO partial pressures probably directly impact the formate ion concentration in the reaction system by shifting the following reaction equilibrium to the right:

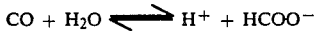

$$CO + H_2O \rightleftharpoons H^+ + HCOO^-$$

There is generally an increasing improvement in coal properties with increasing CO partial pressure ($P_{co}$). A suitable range is 500 to 1500 psi (initial) at ambient temperature, preferably about 850 to 1000 psi. There is also generally an increasing improvement in coal properties with increasing weight % CO fed relative to coal, or "treat". A suitable treat range is 40 to 100 weight % (dry coal basis), preferably about 60–90 weight % CO.

The total pressure at conditions (including $H_2O$ vapors, $CO_2$, $H_2$, CO, and $C_1$–$C_4$) is suitably in the range of about 1800 to 4500 psi, preferably about 2800 to 4500 psi, depending on $P_{co}$ and the temperature, which in turn determines the water partial pressure ($P_{H2O}$).

One of the most important properties for predicting the reactivity of a coal material in hydroconversion is the volatile matter content. The treat rate of CO in the pretreatment stage has a very significant effect on the volatile matter content of coal generated during the pretreatment. A treat rate of 84 weight % CO at 650° F. produces a coal with both high volatile matter (or H/C) and high solubility which has a correspondingly high conversion. However, at 42 weight % CO treat, the best volatile matter (H/C) and conversion are obtained at 600° F. This occurs because the shift reaction, which results in loss of hydrogen from water to the gas phase, is more competitive with coal hydrogenation at 650° F. than at 600° F. The lower temperature results in better hydrogenation at CO lean conditions. However, higher solubility, which is important in the extraction stage of this invention is better realized at 650° F. than at 600° F. Therefore, higher pretreatment temperatures are preferred. (Volatile matter is taken as the sum of the volatile content of the residue recovered after pretreatment with aqueous carbon monoxide and the converted material during the pretreatment itself, including $CO_2$ and chemical $H_2O$ and other light oxygenated species such as phenols, alcohols, organic acids and the like).

Generally, coal quality improves with increasing residence time in the pretreatment zone. A suitable residence time at 650° F. ranges from about 10 minutes to 5 hours, preferably, from an economic standpoint, 20 minutes to 2 hours.

Efficient mixing and good contact between the CO and coal in the pretreatment reactor is desirable. This can be accomplished with a mechanical stirrer and/or with stationary baffles that create high turbulence.

Recycle of aqueous phase compounds to the pretreatment reactor is an optional feature which can provide certain advantages. Recycle may aid in dissolution of the coal as a result of the low molecular weight organic solvents (e.g., alcohols, phenols, and carboxylic acids) contained in the recycle solution. Additionally, much of the calcium and sodium based on mineral components of the coal are dissolved in the water during the pretreatment step. Separate tests have shown that these compounds accelerate the desired chemistry. A recycle rate (ratio of recycle to make-up water) of 3:1 to 10:1 is suitable.

Certain soluble acids or metal salts of acids or bases, particularly those made in the reaction system during pretreatment, all can act as promotors to enhance the pretreatment of the coal by improving coal solubility at a given temperature and pressure. The most preferred promotors are sodium or calcium formate. Calcium or sodium hydroxide or oxide, and ammonium sulfide or ammonium bisulfide or hydrogen sulfide are also preferred. The promotors should be present in the aqueous system in the amount by weight of 0.5 to 50%, preferably 0.5 to 10%, and most preferably 1 to 5%, except in the case of the afore-mentioned sulfides which add little to the cost of the process even at a much higher weight % loading.

Extraction.

Following pretreatment, the coal material is subjected to extraction wherein soluble carbonaceous material is extracted from the pretreated coal using an organic solvent. Preferably the solvent is a process derived stream, either distillate (400–650° F.), VGO 650–1000° F.) or some combination thereof. The extracted material is separated from the ash-containing residue by settling and filtration or other means.

The extraction step in effect fractionates the components of the coal material according to its hydrogen to carbon ratio and molecular weight. In general, the more hydrogen rich or lower in molecular weight the component, the greater its solubility in the solvent. Because of the higher hydrogen content of the extracted material, higher conversion and greater selectivity in the subsequent hydroconversion is obtained. On the other hand, the residue is more hydrogen deficient than the coal fed to pretreat.

The raw coal feedstock is thereby split into two fractions. The first fraction, containing the ash residue, suitably contains 0 to 40% of the daf (dry ash free) pretreated coal material. A second fraction, containing the coal extract and essentially ash free (an ash content of less than 2%, preferably less than 1% by weight), suitably contains 60 to 100% of the daf pretreated coal material. For example, with a typical Wyoming coal, the coal to pretreat may have an H/C ratio of 0.82, the extract-containing fraction may have an H/C ratio of 0.97 and the residue-containing fraction may have an H/C ratio of 0.77 (with an ash content of greater than 25%).

The first, or ash-containing, fraction is preferably sent to a partial oxidation unit to supply carbon monoxide and hydrogen to the integrated process. The second fraction, containing the extract and solvent, is introduced into a hydroconversion or coal hydroconversion step where the coal extract is converted into lighter products. Optionally, part or all of the solvent may be removed by distillation prior to sending the extract to the hydroconversion stage.

In practice, a 650° F.+ extraction solvent and 650° F.+ hydroconversion product are recycled to the hydroconversion reactor to the extent needed to produce a net 650° F.− product by extinction of 650° F.+ product. A sufficient amount of VGO is set aside for the purpose of extraction.

The present process provides an advantage over other hydroconversion processes in that the hydrocarbonaceous stream sent to the hydroconversion zone is essentially ash free even when handling high ash coals. The amount of ash is preferably less than about 1%, most preferably less than 0.1% by weight. Furthermore, the hydroconversion feed (comprising the extract from pretreated coal) is enriched in hydrogen and is more readily converted with better liquid/gas selectivity in the hydroconversion step than pretreated coal which has not been extracted.

Another benefit is that less total material is sent to the reactor, since ash and other unusable material are removed beforehand. Therefore, additional reactor volume is available to achieve higher conversion by longer residence time. Still another benefit of the present process is that the extract is easier to handle than a solids-liquids mixture. For example, separations can usually be accomplished by a simple distillation.

Surprisingly, when compared on the basis of feed coal to pretreatment, it has been found that the present process, during subsequent hydroconversion, generates as much or more of the desirable liquid products (and less gas), that is more naphtha and distillate, as other coal hydroconversion processes not involving an extraction stage, even though significantly less hydrocarbon is sent to the hydroconversion step. The present extraction step selectively diverts the worst 15% to 25% of the coal (daf pretreated) to a partial oxidation unit and the remainder is almost entirely converted. That is, of the approximately 75% to 85% going to hydroconversion, virtually 100% can be converted. More distillate and vacuum gas oil (VGO) is obtained in the present process. In summary, even without up to 25% of the original coal going to the hydroconversion, it is possible to obtain with extraction a higher conversion to 1000° F.− liquids on a coal feed to pretreatment basis than with no extraction. Moreover, this higher liquid conversion is possible with a lower hydrogen consumption in the hydroconversion step.

Suitable extraction solvents for use in the present process to separate hydrocarbons from the ash-containing residue include ordinary organic solvents —hexane, benzene, dichloromethane, acetone, tetrahydrofuran (THF), pyridine and the like—and process derived liquids from coal, shale, petroleum and/or bitumen processing.

Preferably, the solvent is internally derived from the feed, e.g. recycled from a subsequent separation or upgrading step, either wholly or in part. Process derived solvents are used at elevated temperatures, generally in the range of room temperature to 800° F. Satisfactory solubility is obtained at moderate temperatures. The preferred solvent is vacuum gas oil (VGO), since it is most like the material extracted, and its high boiling range allows the extraction to proceed with little or no reactor pressure even at higher temperatures. It is also a good choice because it has relatively less value as a product and can be sent to partial oxidation without expensive losses (typically less than about 10% of the VGO can be lost to partial oxidation without economic concerns). Coal derived VGO boils in the range of about 650 to 1000° F.

Preferably, the extraction conditions are set such that the carbon content of the ash-containing residue meets process requirements for obtaining $H_2$ and CO from partial oxidation. The above mentioned 30% to partial oxidation and 70% to hydroconversion split of the coal during the extraction stage generally accomplishes this goal. Alternately, in the case where the carbon content is low, the residue may either be oxidized or combusted for heat.

The extraction stage can occur either following pretreatment (ex-situ) or, by co-feeding the extraction solvent to the pretreatment zone, during pretreatment (in-situ). Another option is to extract the pretreated coal and, without separation, subject both the coal extract and coal solids residue to hydroconversion. While this foregoes the benefits of isolating a hydrogen rich extract for hydroconversion and a high ash, hydrogen lean residue for partial oxidation, nevertheless this so-called "pre-soak", or extraction without separating residue prior to hydroconversion, still has the advantage of enhancing reactivity of the coal materials during hydroconversion. This "pre-soak" is believed to mainly work by opening pores in the coal material.

Hydroconversion.

Following extraction of the pretreated coal, at least the extract is subjected to hydroconversion to produce lighter liquids. The solvents employed in hydroconversion are solvents which may contain anywhere from ½ to about 2 weight % donatable hydrogen, based on the weight of the total solvent. Preferred solvents include coal derived liquids such as coal vacuum gas oils (VGO) and coal distillates or mixtures thereof, for example, a mixture of compounds having an atmospheric boiling point ranging from about 350° F. to about 1050° F., more preferably ranging from about 650° F. to less than about 1000° F. Other suitable solvents include aromatic compounds such as alkylbenzenes, alkylnaphthalenes, alkylated polycyclic aromatics, heteroaromatics, unhydrogenated or hydrogenated creosote oil, tetralin intermediate product streams from catalytic cracking of petroleum feedstocks, shale oil, or virgin petroleum streams such as vacuum gas oil or residuum, etc. and mixtures thereof.

Preferably, the catalyst employed in the hydroconversion stage is comprised of well-dispersed, submicron size particles. Preferably, the catalyst is a sulfided metal containing compound. Most preferably, the catalyst is formed from a precursor which is an organic oil-soluble metal compound. The precursor is typically added to the solvent after extraction and before upgrading, so as to form a mixture of oil soluble metal compound, solvent and coal in a mixing zone. The catalyst employed in the present invention can also be a conventional supported (i.e. fixed bed) metal sulfide containing catalyst, for example Ni and Mo on a solid porous alumina support.

Suitable oil-soluble metal compounds convertible to active catalysts under process conditions include (1) inorganic metal compounds such as halides, oxyhalides, hydrated oxides, heteropoly acids (e.g., phosphomolybdic acid, molybdosilicic acid); (2) metal salts of organic acids such as acyclic and alicyclic aliphatic carboxylic acids containing two or more carbon atoms (e.g., naphthenic acids); aromatic carboxylic acids (e.g., toluic acid); sulfonic acids (e.g., toluenesulfonic acid); sulfinic acids; mercaptans, xanthic acid; phenols, di- and polyhydroxy aromatic compounds; (3) organometallic compounds such as metal chelates (e.g., with a 1,3-diketone, ethylene diamine, ethylene diamine tetraacetic acid, dithiocarbamate, xanthate, etc.); (4) metal salts of organic amines such as aliphatic amines, aromatic amines, and quaternary ammonium compounds.

The metal constituent of the oil soluble metal compound is selected from the group consisting of Groups VA, VIA, VIIA and VIIIA of the Periodic Table of Elements, and mixtures thereof, in accordance with the Table published by Sargent-Welch Scientific Company, copyright 1979, that is, vanadium, niobium, tantalum, chromium, molybdenum, tungsten, manganese, rhenium, iron, cobalt, nickel and the noble metals including platinum, iridium, palladium, osmium, ruthenium and rhodium. The preferred metal constituent of the oil soluble metal compound is selected from the group consisting of molybdenum, vanadium, chromium, nickel and cobalt. More preferably, the metal constituent of the oil soluble metal compound is selected from the group consisting of molybdenum, nickel, and cobalt. Preferred compounds of the metals include the salts of acyclic (straight or branched chain) aliphatic carboxylic acids, salts of alicyclic aliphatic carboxylic acids, heteropolyacids, hydrated oxides, carbonyls, phenolates and organic amine salts. More preferred types of metal compounds are the heteropoly acids, e.g., phosphomolybdic acid (PMA). Another preferred metal compound is a salt of an alicyclic aliphatic carboxylic acid such as a metal naphthenate. Preferred compounds are molybdenum naphthenate, vanadium naphthenate, chromium naphthenate, and molybdenum-, cobalt-, or nickel-dibutyl diothiocarbamates or xanthates. Iodine may be used as a catalyst.

The preferred catalyst particles, containing a metal sulfide in a hydrocarbonaceous matrix formed within the process, are uniformly dispersed throughout the feed. Because of their ultra small size, 0.02 to 2 microns, there are typically several orders of magnitude more of these catalyst particles per cubic centimeter of oil than is possible in an expanded or fixed bed of conventional catalyst particles. The high degree of catalyst dispersion and ready access to active catalyst sites affords good reactivity control of the reactions.

Since such catalysts are effective at weight parts per million quantities of metal on feed, it is economically feasible to use them without recovery from the bottoms purge stream. Most of the catalyst returns to the reactor with the bottoms recycle stream. Only a small amount of "makeup" catalyst needs to be added.

The catalyst loading is flexible, ranging from parts per million (ppm) to weight percents (the latter limited by pumping constraints in a slurry reactor). Higher catalyst loadings increase conversion to low boiling liquids, and decrease heteroatom content, with better selectivity to liquid over gas. The catalyst may be used in the slurry mode or, with an essentially ash free extract, in a fixed bed. Conditions may be varied to produce a more or less saturated/hydrocracked product suitable as (or for conversion to) diesel or mogas, respectively. Mild hydroconversion temperatures in the range of 650–800° F. are preferably used.

Normal catalyst loadings on the order of 1000 ppm, ranging from 100 to 5000 ppm, are suitable for the hydroconversion reaction system of the present process. The oil-soluble metal-containing compound make-up (not including additional amounts from recycle) is added in an amount sufficient to provide from about 10 to less than 5000 wppm, preferably from about 25 to 950 wppm, more preferably, from about 50 to 700 wppm, most preferably from about 50 to 400 wppm, of the oil-soluble metal compound, calculated as the elemental metal, based on the weight of coal extract in the mixture. Catalyst make-up rates are suitably from about 30 ppm to 500 ppm on coal. The remainder will normally be supplied from recycling the catalyst-containing 650° F.+ bottoms.

A significant advantage of the high catalyst loadings, however, counterbalanced to some extent by increasing catalyst material and process costs, is that a nearly finished product is produced. By high catalyst loadings is meant between about 1 and 10 weight %, preferably between about 1 and 5%. (A figure of 1% equals 10,000 ppm). By nearly finished product is meant liquids characterized by low heteroatom levels. With high catalyst loadings, a typical product has less than about 5 ppm nitrogen, 194 ppm sulfur, 1300 ppm oxygen and a hydrogen to carbon ratio of at least about 1.7. The significance of obtaining a nearly finished product is that it may obviate a second upgrading reactor (e.g. hydrotreatment, hydrodesulfurization, or hydrodenitrogenation) which is usually a large part of the overall process cost and consumes substantial amounts of hydrogen, one of the more expensive reagents in a refinery. Catalyst levels may be selected to achieve a nearly finished product characterized by a nitrogen level of about 0 to 1500 ppm, a sulfur level of about 200 to 400 ppm, and an product suitable as feed for fluid catalytic cracking which does not require a high pressure hydrogen atmosphere. Suitably at least 50 wt%, preferably at least about 90 wt% or more of the nitrogen, sulfur, and oxygen in the coal extract is removed in the hydroconversion zone.

The benefits obtained by utilizing relatively high catalyst loadings, in the form of a catalyst slurry during hydroconversion, are realized without having to deal with a difficult catalyst recovery or recycle step, since as a result of the previous extraction stage, the hydroconversion zone is very low in ash and there are almost no 1000° F.+ bottoms from the hydroconversion step. Without the extraction stage, substantial catalyst would be lost, since, as a result of the need to prevent the build-up of ash, a portion of the bottoms is flushed out taking along a proportional amount of the catalyst. Although in principle the catalyst can first be separated from the bottoms, there is currently no economical method of doing this. In the present process, almost 100% of the catalyst can be recycled with no difficulty. The high catalyst loadings result in obtaining a nearly finished product, which means that some or all secondary upgrading steps can be eliminated and the economics greatly enhanced.

Various methods can be used to convert a catalyst precursor, in the coal-solvent slurry, to an active catalyst. It is usually better to form the catalyst after dissolving the soluble precursor in order to obtain better dispersion. One method of forming the catalyst from the precursor or oil-soluble metal compound is to heat in a premixing unit prior to the hydroconversion reaction, the mixture of metal compound, coal extract and solvent to a temperature ranging from about 600° F. to about 840° F. and at a pressure ranging from about 500 to about 5000 psig, in the presence of a hydrogen-containing gas. A sulfur-containing reagent such as $H_2S$, $CS_2$ (liquid), or elemental sulfur should be introduced. The hydrogen-containing gas may be pure hydrogen but will generally be a hydrogen stream containing some other gaseous contaminants, for example, a hydrogen-containing stream produced from the effluent gas in a reforming process.

Another method of forming the catalyst is to add the catalyst precursor to the pretreatment step. This will only work when the following extraction is the "presoak" option, i.e. no filtration. Filtration would remove the catalyst particles.

If $H_2S$ is employed as the source of sulfur to activate the catalyst, then the hydrogen sulfide may suitably comprise from about ½ to about 10 mole % of the hydrogen-containing gas mixture. Hydrogen sulfide may be mixed with hydrogen gas in an inlet pipe and heated up to reaction temperature in a preheater, or may be part of the recycle gas stream. High sulfur coals may not require an additional source of sulfur. The catalyst precursor treatment is suitably conducted for a period ranging from about 5 minutes to about 2 hours, preferably for a period ranging from about 10 minutes to about 1 hour, depending on the composition of the coal and the specific catalyst precursor used. Such a thermal treatment in the presence of a reducing gas (hydrogen or carbon monoxide) or in the presence of a reducing gas and hydrogen sulfide converts the metal compound to the corresponding metal-containing active catalyst which acts also as a coking inhibitor.

Another method of converting a catalyst precursor or oil-soluble metal compound to a catalyst for use in the present process is to react the mixture of metal compound, coal extract and solvent with a hydrogen-containing gas in the hydroconversion zone, itself at coal hydroconversion conditions.

Although the oil-soluble metal compound (catalyst precursor) is preferably added to a solvent, and the catalyst formed within the mixture of coal extract and solvent, it is also possible to add already formed catalyst to the solvent, although as mentioned above, the dispersion may not be as good.

In any case, a mixture of catalyst, solvent, and coal extract is sent to the hydroconversion zone which will now be described. The coal hydroconversion zone is maintained at a temperature ranging from about 650 to 950° F., preferably from about 650 to 850° F., more preferably from between about 725 and 800° F., and a hydrogen partial pressure ranging from about 500 psig to about 5000 psig, preferably from about 1200 to about 3000 psig. The space velocity, defined as the volume of the coal and solvent feedstock per hour per volume of reactor (V/H/V), may vary widely depending on the desired conversion level. Suitable space velocities may range broadly from about 0.1 to 10 volume feed per hour per volume of reactor, preferably from about 0.25 to 6 V/H/V, more preferably from about 0.5 to 2 V/H/V.

The 650° F.+ bottoms from the hydroconversion stage may be recycled, in part, back to the hydroconversion zone, if desired, to increase conversion by bottoms reaction to extinction. The bottoms which are purged are preferably gasified, for example by partial oxidation, along with the residue from the extraction, to produce hydrogen, carbon monoxide and heat. With bottoms recycle, a suitable solvent:coal:bottoms ratio by weight to the hydroconversion zone will be within the range of about 2.5:1:0 to about 0.5:1:2. Reducing the solvent to solids ratio improves the thermal efficiency of the process because the reactor size is reduced for a given coal throughput, or allows for more throughput. A typical process solvent boiling range is from 450 to 650° F. IBP to about 1000° F. FBP.

The range of process conditions recommended for the hydroconversion stage, according to an embodiment considered the best mode, is summarized in Table 1 below:

TABLE 1

| Variable | Broad Range | Preferred Range |
|---|---|---|
| Hydroconversion Temp., °F. | 650–950 | 650–800 |
| Pressure, psig | 500–5000 | 1200–3000 |
| Slurry, Residence Time, Min | 25–480 | 60–240 |
| Solvent/Extract Ratio, by wt | 0.5–2.5 | 0.8–1.2 |
| Bottoms/Extract Ratio, by wt | 0–2 | 0–1.5 |
| $H_2$ treat, wt % on extract | 4–12 | 6–10 |

TABLE 1-continued

| Variable | Broad Range | Preferred Range |
|---|---|---|
| Sulfur on Extract, wt % | 0–10 | 0–4 |
| Solvent Boiling Range, °F. | 450–1100 | 650–1000 |
| Catalyst Metal on Extract, wppm | 100–100,000 | 100–20,000 |

A conversion of greater than 90% to various products based on wt% daf coal is achieved. As noted above, however, high catalyst loading can offer significant improvements, for example, better liquids selectivity and conversion with a corresponding decrease in gas yield. Normally, low hydroconversion temperature results in low coal extract reactivity. However, hydroconversion reactivity which allows good conversion and good liquids selectivity can be achieved at lower temperatures by high catalyst loadings and/or when the coal is first pretreated in the above described aqueous carbon monoxide environment.

The process of the invention may be conducted either as a batch or as a continuous type process. Suitably, there are on-site upgrading units to obtain finished products, for example transportation fuels.

Description of the Drawing

Referring now to FIG. 1, pulverized coal is intro by line 1 into a mixing and pretreatment zone 3 wherein the coal is mixed with water, carbon monoxide, and an optional organic solvent introduced by lines 5, 6 and 7, respectively. This coal mixture is subjected to elevated temperature and pressure conditions as described heretofore. Following pretreatment, the coal can be suitably dewatered in a conventional slurry thickener or settler followed by a standard gravity filter belt press or the like which squeezes bulk water from the coal material. Water is shown removed from the pretreatment zone in FIG. 1 by line 13. Typically, the water content of the coal mixture is reduced to the equilibrium moisture content of 8 to 10% plus free water of about 10%. Preferably, a slurry drier (shown in FIG. 2), wherein the coal material with absorbed moisture is mixed with hot solvent can be utilized to remove further water. Typically, the coal is dried to about 0.5 weight % water before hydroconversion. On the other hand, coal sent via line 14 to partial oxidation unit 33, to be described later, is sent typically from the filter press without further drying. The gases remaining or produced in the pretreatment zone, typically $CO_2$, CO, $H_2O$, $H_2$ and $C_1$–$C_4$ hydrocarbons, are removed via line 15.

Figure 2:
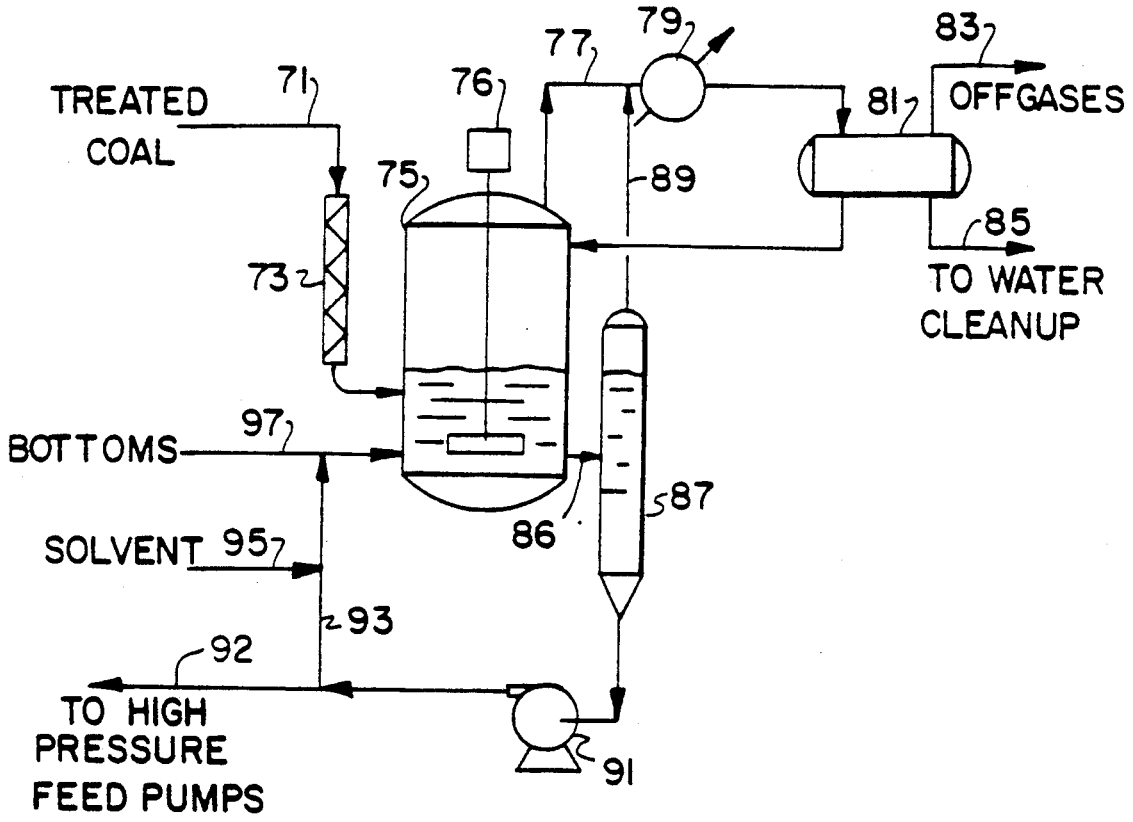
FIG. 2 shows a process flow diagram illustrating a means for dewatering a coal mixture formed during pretreatment.

FIG. 2 illustrates a slurry dewatering system. The pretreated coal feed is introduced via line 71 through a screw feeder 73 for introducing the pretreated coal into a slurry drier 75. A mixer 76 gently mixes the coal mixture while allowing off gases and water vapor to escape via overhead line 77. The overhead vapors are cooled in condenser 79 and water is accumulated in collector 81. The off gases in line 83 are treated in an environmentally acceptable manner to remove pollutants. The water stream 85 is sent for cleanup and recycle to the pretreatment zone and/or purge. The bottoms from the slurry drier 75 are removed via line 86 and passed to a vessel 87 where they are collected, while allowing further escape of offgases and water vapor via line 89. The dewatered and degassed coal is then sent via pump 91 to high pressure feed pumps for further processing. A portion of the coal leaving the slurry drier may be recycled via line 93, and make-up solvent is optionally introduced via line 95. The dewatered coal in line 92 may be sent for further dewatering or drying. Additional bottoms from downstream may be introduced via line 97.

Water which is recycled from dewatering operations may be partially purged of organic solutes, for example, to recover valuable hydrocarbons. A certain amount of recycle water may be pulled off as blow down, and organic compounds such as phenolic and carboxylic acids and salts recovered from this stream.

Following pretreatment and dewatering, the coal enters extraction zone 4, preferably in a conventional countercurrent or concurrent extractor. The extraction may be carried out in staged units. In passing to, or after the coal is passed into, the extraction zone 4, it is typically mixed with a solvent by line 22. Although all or some of the solvent may be introduced into the pretreatment zone 3 (as in the in-situ case), additional solvent is usually added prior to carrying out the extraction. The solvent may be introduced into the extraction zone in order to obtain a total solvent to coal weight ratio at conditions of from about 1:1 to 5:1, preferably about 2:1. The residence time of the coal ranges from about 10 minutes to 2 hours, preferably about 20 minutes. A suitable temperature is 200 to 650° F., preferably 350 to 650° F., most preferably 500 to 650° F.

Typically, a pressure of 500 psi can be maintained in the extraction zone in order to keep the solvent from volatizing. However, some solvents, especially process derived solvents such as coal distillate or VGO, can be kept under much lower pressures.

It is preferred that no less than 70% by weight dry ash free treated coal be extracted. A suitable range is 70 to 100%, preferably 80 to 100%.

In the extraction zone, the coal mixture is agitated, whereby a hydrocarbonaceous material is extracted from the coal material and taken into solution in the solvent leaving a solid coal residue comprising insolubles and ash. Converting the coal material into a soluble form reduces mass transport limitations and minimizes or precludes regressive reactions in hydroconversion that lead to refractory bottoms.

The mixture of solvent, extract and residue is then passed into a first separation zone 16, where the mixture is separated into a liquid or solvent phase, in line 18, containing all of the solvent soluble hydrocarbonaceous product components (substantially all of the solubles from the coal) and a solids-containing phase, in line 20, containing all of the solvent insoluble hydrocarbonaceous material (substantially all of the ash from the coal) charged to the extraction zone 4. Separation can be readily accomplished by use of a filter means or centrifuge. The solvent insolubles-containing phase is typically a solid, its make-up depending upon the composition of the particular coal used in the operation. In a second separation zone 24, a part or all of the solvent is separated from the solvent soluble hydrocarbonaceous product by fractionation. Since the solvent soluble hydrocarbonaceous product generally has an initial boiling point substantially higher than the boiling point of the solvent, it is conveniently separated from the solvent in a distillation column.

The separated solvent may be recycled back to the extraction zone via line 26 for admixture with the pretreated coal in the extraction zone 4. In the case where pretreatment and extraction occurs together, solvent may be recycled to the pretreatment zone 3.

Figure 3:
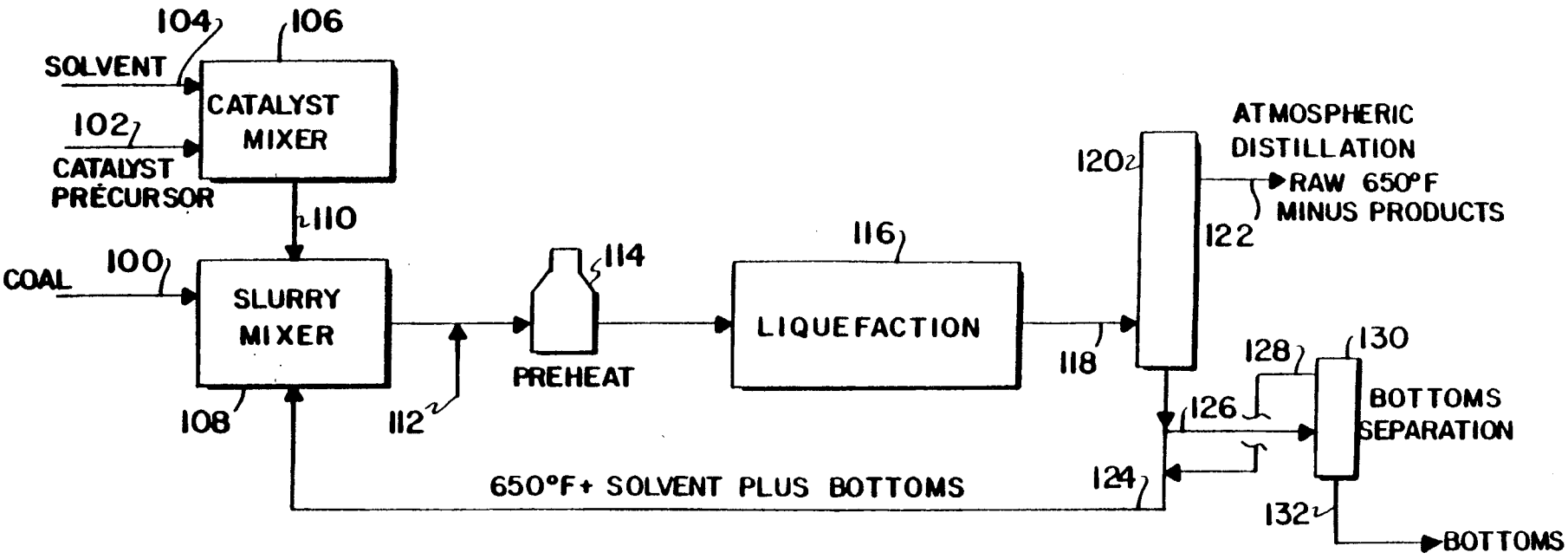
FIG. 3 shows a process flow diagram illustrating a process for upgrading a liquid effluent of a hydroconversion reactor.

Following extraction, the extract is introduced into a mixing zone 17 (and analogously, in FIG. 3, the extract in line 100 is introduced into mixer 108) wherein additional solvent is added by line 21 (124 in FIG. 3) to the extract. Optionally, recycled bottoms from downstream can be introduced via line 21 (128 in FIG. 3). A catalyst precursor-containing solvent is introduced into the mixing zone 17 via line 23. In FIG. 3, a solvent stream 104 and catalyst precursor 102 are introduced into a catalyst mixing zone 106. The components in the mixing zone are intimately mixed to form a homogenous mixture.

The mixture of oil-soluble metal catalyst precursor, solvent, and coal extract is introduced into preheating zone 114 as shown in FIG. 3. A gaseous mixture comprising hydrogen, and, optionally hydrogen sulfide, is introduced into this zone via line 112. The preheating zone is suitably maintained at a temperature ranging from about 600–700° F. and a pressure of about 2000–2500 psi.

The coal extract and catalyst slurry are then introduced into a hydroconversion zone 29 (or 116 in FIG. 3). The hydroconversion reactor may be any suitable vessel or reactor capable of withstanding the desired temperature and pressure hydroconversion conditions. Typically, there are a plurality of staged hydroconversion reactors (not shown), the conditions of each reaction zone being set to maximize desired equilibrium limits and kinetic rates and to obtain the best profile of products.

The feed to the hydroconversion zone is typically in a 0.5:1 to 1:1 ratio of solvent to coal extract by weight. Make-up solvent may be introduced as needed. Preferably, the solvent may be sent to the hydroconversion zone and recycled following hydroconversion. A 1:1:1 solvent:coal extract:bottoms recycle to the hydroconversion zone is suitable. It is preferred to recycle as much 650° F.+ liquids as possible to maximize the yield of lighter liquids.

The product of the overall hydroconversion process is significantly improved compared to the base process (the base process referring to an overall process without the pretreatment stage and/or extraction stage). For example, a typical conversion to 1000° F.− product, for a catalytic hydrogenation hydroconversion base process, was about 75%, based on the DAF weight % of original coal feed. A typical product (from Wyoming sub-bituminous coal) comprised about 14% $C_1$–$C_4$ gas and 43.6% $C_5$ 1000° F.− (12% naphtha, 30% distillate and 2% VGO in the 1000° F.− boiling point range). Hydrogen consumption was about 5.3% on daf feed coal. In comparison, by adding an aqueous carbon monoxide pretreatment stage, the gas make and hydrogen consumption decreased and the amount of naphtha and distillate in the product increased. By adding an extraction step as well, the gas make and hydrogen consumption further decreased and the amount of naphtha and distillate further increased. The increased amount of naphtha produced by the use of the pretreatment and extraction step was particularly pronounced. A typical product slate for a pretreated and extracted coal was 11.8% $C_1$–$C_4$ gas, 83.1% $C_5$–1000° F., and 98.3% total conversion (yields on DAF extract).

A hydrogen-containing gas is introduced directly into hydroconversion reactor 29 or alternatively, before the reactor via line 31. The hydrogen-containing gas may be pure hydrogen, but will generally be a hydrogen stream containing some other gaseous contaminants, for example, a hydrogen-containing gas produced from the effluent gas generated during reforming. Suitable hydrogen-containing gas mixtures for introduction into the hydroconversion zone include raw synthesis gas, that is, a gas containing from about 5 to about 50 mole % hydrogen, preferably from about 10 to 30 mole % carbon monoxide. Another suitable hydrogen-containing gas is obtainable from the steam reforming of natural gas. Pure hydrogen if available is also suitable.

Preferably, hydrogen is provided by a partial oxidation unit 33. In a suitable partial oxidation process, coal or a coal fraction is pumped into a partial oxidation reactor, essentially a gasifier, in the form of small droplets of water slurry, where it is mixed with oxygen (for example, from an oxygen plant) and steam. The amount of oxygen is adjusted so that oxidation of the coal material all the way to $CO_2$ primarily does not occur. Some $CO_2$ is made, necessarily, to provide process heat for the main reactions, which are, in the net, endothermic. These reactions are as follows:

$$2C+O_2 \rightarrow 2CO$$

$$C+H_2O \rightarrow CO+H_2$$

The mixture of CO and $H_2$ produced, known as "synthesis gas", following acid gas removal in separator 35, can be sent to a PRISM membrane unit 41 (registered trademark of Monsanto Corporation) where $H_2$ is separated and removed via line 43, and the CO in line 6 is used for the pretreatment step. In addition, some of the gases from the partial oxidation unit can be passed over a Ni catalyst and contacted with additional water in reactor 39 to shift CO and produce $CO_2$ and additional $H_2$ for plant needs, according to the following water gas shift reaction:

$$CO + H_2O \rightleftharpoons CO_2 + H_2$$

Following acid gas removal in separator 37, $H_2$ is obtained in line 47. The hydrogen in lines 43 and 47 can be used in the hydroconversion reaction zone.

The partial oxidation unit, according to the present integrated process, operates on coal and extraction residue, basically in solid form, having a reduced equilibrium moisture content due to the coal dewatering and deoxygenating effect of the pretreatment stage. For example, instead of 55 weight % solids characteristic of low rank coal feeds, it is possible to have about 60% weight solid in the feed to the slurry partial oxidation unit, preferably about 65%. (Of course, to some extent this advantage must be balanced against investment costs, operating costs, and waste water treating costs of the pretreatment unit). The biggest benefit will be for the lower rank coals. Since there is less water in the partial oxidation reactor, significantly less coal is required to provide the heat (about 2500° F.) required for gasification (water consumes much energy due to its high latent heat of vaporization) and the coal can be slurried at a higher solids concentration for partial oxidation, thereby increasing the thermal efficiency. Accordingly, improving the efficiency of moisture removal from low rank coals can have a significant impact on the overall economics of processing the coal.

Returning to the hydroconversion zone 29 in FIG. 1, the effluent in line 49 comprises light gases, an oil product, an essentially ash-free bottoms, and catalyst slurry. This effluent is passed to a separation zone 51 (including an atmospheric pipestill) from which gases are removed overhead by line 53. The gases typically comprise $C_1$-$C_4$ hydrocarbons, $H_2$, and acid gases. The $C_1$-$C_4$ gases may be used as fuel, for example to preheat the coal. The $H_2$ may be recycled to the coal hydroconversion zone via line 31 or used for upgrading the liquid products. The gases may be first scrubbed by conventional methods to remove any undesired amounts of hydrogen sulfide, ammonia, water and carbon dioxide.

The liquefaction effluent is separated in zone 51 by conventional means, e.g. distillation, into a hydrocarbonaceous oil (atmospheric boiling point below about 650° F.), which is sent via line 57 to a fractionation zone 61, and a bottoms comprising heavy liquids, solvent, and catalyst (atmospheric boiling point above about 650° F.+). This bottoms is divided between recycle lines 21 and 55, in a ratio which is determined by the desired bottoms purge rate and/or the desired amount of extraction solvent make-up. In line 21, the bottoms is recycled directly back to mixing zone 17 for reuse in the hydroconversion zone. This is desirable to increase conversion and recycle catalyst. In line 55, bottoms is carried to vacuum separator 59, where the heavy solvent (atmospheric boiling point 650° F. to 1000° F.) is separated from the residua by vacuum distillation. The heavy solvent is recycled via line 19 to either mixing zone 17 or to extraction zone 4. The residua may be sent to optional catalyst recovery zone (not shown), or mixed and disposed of in an environmentally acceptable manner. Since the residua is essentially ash free, the catalyst recovery zone can readily yield catalyst for reuse, for example, in mixing zone 17.

The hydrocarbonaceous oil produced in the hydroconversion zone is removed from separation zone 51 by line 57 and passed to a fractionation zone 61, wherein various boiling range fractions can be obtained. Such fractions may be sent to an upgrading zone 63, where treatment with hydrogen in line 65, optionally in the presence of a hydrotreating catalyst, yields a final product in line 67. In an alternate embodiment of the present invention, at least a portion of the oil product is recycled in line 21 to extraction zone 4, providing a lighter solvent for the extraction step.

Various process options for treating the liquid effluent which is removed from the hydroconversion reactor 29 are possible and will be recognized by those skilled in the art. For example, referring to FIG. 3, a preferred embodiment is shown for treating the liquid products. The liquid effluent 118 from hydroconversion reactor 116 is fractionated in an atmospheric fractionator 120 into raw 650° F.− products in line 122. A portion of the atmospheric bottoms is recycled in recycle stream 124 in the desired ratio with coal extract and catalyst. The atmospheric bottoms not required for recycle to hydroconversion are routed in line 126 to a bottoms separator 130 to recover additional 650° F.+ liquids in line 128 for use as solvent. This separator 130 may be a vacuum distillation tower, solvent extraction unit, etc. The residual vacuum bottoms in line 132 can be utilized as feed, separately or blended with coal, to a partial oxidation unit, a hybrid boiler, or a conventional boiler for process heat or hydrogen.

The recycle atmospheric bottoms stream contains active, well-dispersed microcatalyst. Make-up catalyst is needed to maintain catalyst concentration due to loss of catalyst purged with the bottoms.

In another embodiment, a fractionator following the hydroconversion zone may be used to separate the effluent into a light liquid or naphtha, $C_5$ to 400° F.−, a distillate at 400-650° F. and a solvent at 650-1000° F.

The solvent is preferably recycled to the hydroconversion reactor and/or the extraction reactor, and the bottoms from the fractionator can be recycled to the hydroconversion reactor, sent to the partial oxidation unit, or purged.

The following examples illustrate certain preferred embodiments and advantages of the present process. The examples are not intended to limit the broad scope of the the present invention. Other advantages and embodiments of the present invention will be apparent to those skilled in the art from the description provided herein.

EXAMPLE 1

This example illustrates the effect and advantages of an aqueous carbon monoxide pretreatment over 3 control treatments, namely (1) none, (2) decalin and $N_2$, and (3) $H_2O$ and $N_2$. Wyoming sub-bituminous coal with as-received moisture levels of 27–33% was stored under $N_2$ in sealed glass jars. Analysis of the raw coal is given in Table 2.

TABLE 2

| MOISTURE (as received) (Wt %) | ASH Wt % Dry | Analysis of Coal: VOLATILE MATTER (Wt % daf Coal) | O | S | C | H | N |
|---|---|---|---|---|---|---|---|
| 33 | 5.8 | 47.6 | 20.85 | 0.22 | 73.11 | 4.8 | 1.03 |

For the aqueous experiments, the coal was ground quickly in a mill to −30 mesh and resealed in glass jars to minimize moisture loss. Both raw and treated coal for the hydroconversion experiments were dried overnight in a vacuum oven at 230° F. and ground to 30×100 mesh.

The aqueous pretreatments and the hydroconversion experiments were performed in tubing bomb reactors in a fluidized sand bath. The reactors used for the aqueous experiments were constructed from 1 inch 316 stainless steel pipe and had approximate volumes of 70 cc. These reactors could be operated at pressures as high as 4500 psi at temperatures up to 700° F. In the experiments, 6 g of wet Wyoming subbituminous coal (moisture 27–33%) was charged to the reactor with 12 g of deionized water. The reactors were connected to a gas manifold where they were purged and charged with CO or $N_2$. The pressure was measured by a pressure transducer. Six tubing bombs could be charged and reacted simultaneously.

The charged reactors were wired to a rack and submerged in a fluidized sand bath where they were agitated at a rate of 200 cycles per minute. They reached reaction temperature within 5 minutes. In order to assure that the temperature was uniform for all of the reactors, thermocouples were periodically attached to bombs at different points on the rack. Temperatures did not generally vary more than 2° .F between the bombs. As an added precaution, however, duplicate bombs were positioned at different levels on the rack to pick up any unexpected temperature gradients. At the end of the desired reaction period, the bombs were removed from the sand bath and allowed to cool in air for 10 minutes before being quenched in water.

The gas from each cooled bomb was discharged through an empty glass gas displacement bomb (250 or 500 cc) into a water displacement system where the volume was measured. After about half of the gas had been discharged, the gas bomb was isolated and removed from the system. This was then submitted for GC analysis. Operating the system in this way prevented contact of the GC samples with the water in the gas displacement system which selectively absorbs certain components of the product gas. In addition, collecting the GC sample halfway through the gas discharge minimized the effects of selective diffusion of the lighter gases.

The bombs were then opened, and the water was decanted into a vial, taking care not to lose any solid material. The solids were washed into a 50 cc centrifuge tube with deionized water. The bombs were repeatedly scraped and washed with deionized water until all of the solids were removed. The bombs were dried in a vacuum oven and reweighed. They were then washed with MEK to remove any residual solids, redried, and reweighed. Weight loss during the MEK wash was used to estimate unrecovered solids. This was generally below 0.03 g. The centrifuge tubes containing the recovered solids were centrifuged for 15 minutes. The water was decanted and filtered through a tared #2 filter to collect any particles floating on the water layer. The solids in the centrifuge tube and the filter paper were dried overnight in a vacuum oven at 230° F., and the dried solids from the filter paper (usually <0.05 g) were added to the solids in the centrifuge tube. These procedures allowed calculation of overall conversion and gas yields. Liquid and water products were then determined by difference.

To measure the THF (tetrahydrofuran) solubility of the treated coal, the dried solid products were finely ground and 1–2 g was weighed into a 50 cc centrifuge tube. The tube was filled with THF, stirred at room temperature for 2 minutes, and centrifuged for 10 minutes. The THF was then decanted and saved. This procedure was repeated 4 or 5 times, or until the decanted THF was clear. The solids (THF insolubles) were dried as before. To collect the THF solubles, the THF was weathered off under a $N_2$ purge and the solids were dried in a vacuum oven.

Wet Wyoming sub-bituminous coal was reacted in decalin/$N_2$, $H_2O/N_2$, and $H_2O$/CO for 2 hours at 650° F. with a gas charge of 900 psi (cold). Decalin was used as an inert solvent to slurry the coal in order to study its thermal reactions. Pressure at reaction temperature was ~4400 psi for the aqueous systems, and ~2000 psi for the decalin system. The results are shown in Table 3 below:

TABLE 3

Pretreatment of Coal in Aqueous and Thermal Systems at 650° F.
Decalin/$N_2$ Treatment: Dried Coal, 650° F., 2000 psi, 2 Hours
Aqueous Pretreatments: Wet Coal (33% Moisture), 650° F., 4400 psi, 2 Hours

| Properties of Pretreated Coal (Wt % daf Coal) | Pretreatment: None | Decalin/$N_2$ | $H_2O/N_2$ | $H_2O$/CO |
|---|---|---|---|---|
| THF Solubles | 6 | 4 | 8 | 65 |
| H/C Ratio | 0.80 | 0.72 | 0.73 | 0.91 |
| Oxygen | 20 | 16 | 13 | 11 |
| Sulfur | 0.2 | — | 0.2 | 0.2 |

TABLE 3-continued

Pretreatment of Coal in Aqueous and Thermal Systems at 650° F.
Decalin/$N_2$ Treatment: Dried Coal, 650° F., 2000 psi, 2 Hours
Aqueous Pretreatments: Wet Coal (33% Moisture), 650° F., 4400 psi, 2 Hours

| Properties of Pretreated Coal | Pretreatment | | | |
|---|---|---|---|---|
| (Wt % daf Coal) | None | Decalin/$N_2$ | $H_2O/N_2$ | $H_2O$/CO |
| Nitrogen | 1.0 | — | 1.1 | 1.2 |
| Ash (% Dry) | 5.8 | — | 6.0 | 6.0 |
| Moisture (% Coal) | 32 | — | 12 | <9 |

In both aqueous systems, 19 to 20% of the coal was converted to $CO_2$, $H_2O$, and liquids. In the thermal system, the conversion was only 6%. The aqueous/CO treatment increased the solubility of the coal in THF from 6% to 65%. This is an indication that a significant amount of depolymerization and hydrogenation of the coal structure occurs during the treatment. This treatment also increased the H/C ratio of the coal from 0.8 to 0.91. A hydrogen balance indicates that about 0.8 wt% hydrogen (based on raw daf coal) was transferred from the water to the coal. No evidence of depolymerization or hydrogenation of the coal was noted after the decalin/$N_2$ or $H_2O/N_2$ treatments at the same conditions. The THF solubilities of the coals did not increase and the H/C ratios were reduced to 0.72 and 0.73, respectively, due to the removal of coal oxygen as $H_2O$.

The depolymerization and hydrogenation of the coal in aqueous/CO enhances its reactivity for further hydroconversion or hydroconversion processing. Conversely, the decrease in H/C ratio noted after the thermal and $H_2O/N_2$ treatments could debit hydroconversion.

None of the pretreatments significantly altered the ash, nitrogen, or sulfur contents of the coal. Although all of the treatments resulted in some loss of oxygen from the coal, the aqueous pretreatment conditions significantly promoted oxygen removal. This was reflected both in $CO_2$ production during the pretreatment, and in the oxygen contents of the treated coals. Thermally, only 11% of the oxygen was removed, while in $H_2O/N_2$ and $H_2O$/CO, the oxygen content was reduced by 40% and 50%, respectively.

Physical and chemical changes which occur in the coal structure during the aqueous pretreatments cause the coal to lose its capacity to hold moisture. The equilibrium moisture content of the coal was reduced from 32% to 12% in the $H_2O/N_2$ treatment, and to <9% in the $H_2O$/CO pretreatment. Lower equilibrium moisture allows the coal to be slurried in less water which makes the partial oxidation more thermally efficient.

These results show the advantages of the aqueous/CO pretreatment over the thermal and $H_2O/N_2$ pretreatments at the same conditions. The aqueous/CO pretreatment not only provides the highest degree of dewatering and deoxygenation, but also improves solubility and atomic H/C which increases its reactivity in further processing. The other treatments degrade these properties.

EXAMPLE 2

Figure 5:
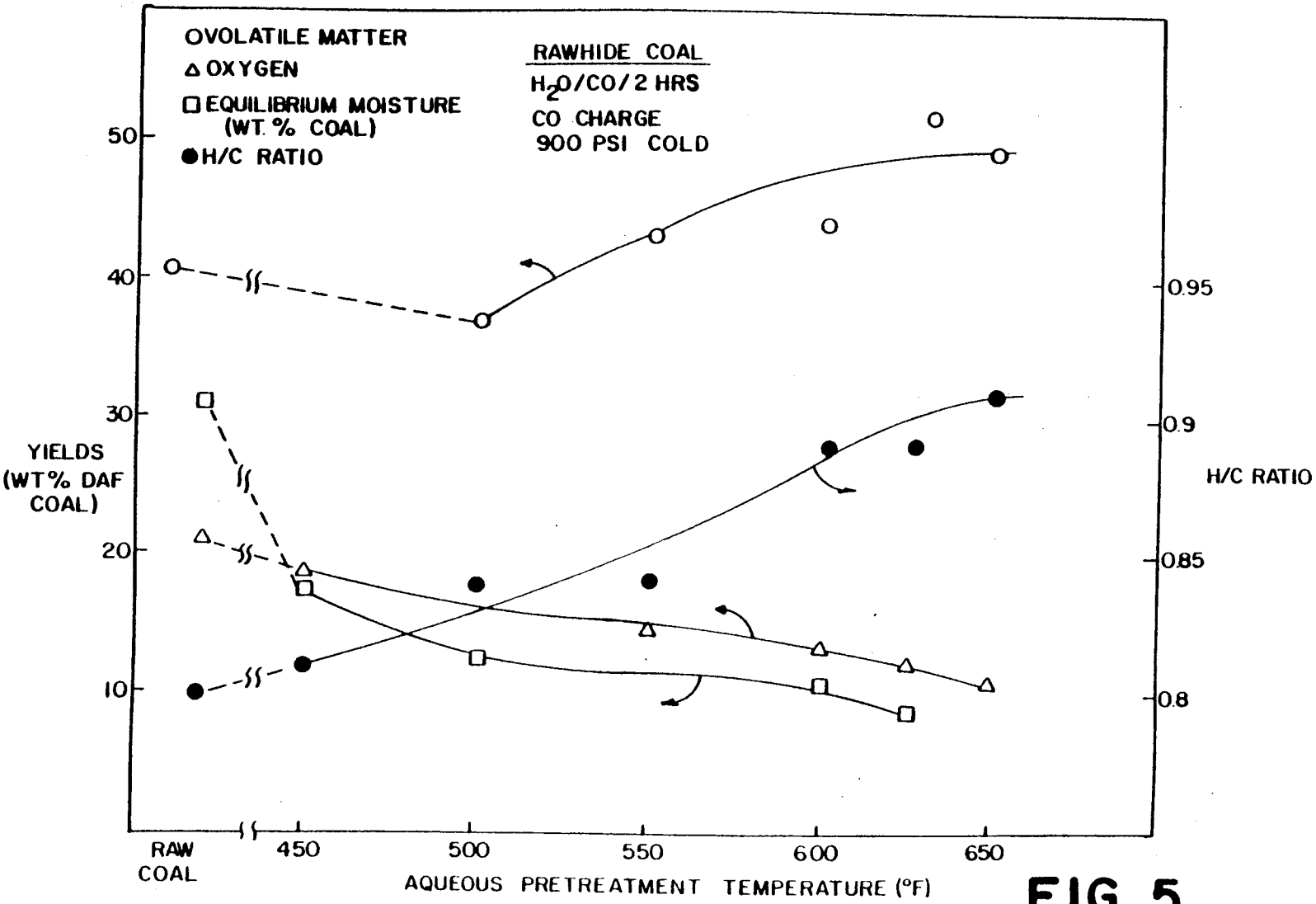
FIG. 5 shows the effect of pretreatment on the properties of coal according to the present invention.

This example illustrates the effect of the pretreatment conditions on both conversion in the aqueous system and on the properties of the treated coal. Wet Rawhide coal was reacted in aqueous/CO for 2 hours with a CO charge of 900 psi (cold) and a CO treat of 84% at temperatures between 450 and 650° F. Because the vapor pressure of water increases almost exponentially in this temperature range, small changes in temperature can significantly impact the pressure of the system. FIG. 5 shows the properties of the treated coals including H/C ratio, oxygen content, volatile matter, and equilibrium moisture.

Various properties and conversions respond differently to the aqueous/CO treatment temperature. There is evidence of hydrogen transfer into the coal from the water at temperatures as low as 450° F. The production of THF solubles takes off at temperatures above about 550° F. Equilibrium moisture drops significantly at temperatures as low as 450° F. Oxygen content shows a slower decline with temperature. At the given CO treat, the conversion and properties such as THF solubility appear to line out somewhat about 625° F.

The effect of CO pressure on conversion and coal properties in the aqueous/CO system at 625° F. was studied. CO pressure was changed by varying the initial CO charge between 700 and 900 psi at room temperature. The measured pressure at reaction temperature varied from 3300 to 3900 psi. Over this range of pressures, essentially no changes were detected in the total conversions to liquids + water + gas, or in the oxygen contents or H/C ratios of the treated coals. A slight increase in volatile matter was noted, but the largest variation was in the production of THF solubles which ranged from 35% to 47% over this set of conditions. The data at the lowest pressure of 3300 psi still displayed substantial improvements in all of the coal properties tested.

Reaction times between 30 minutes and 4 hours were studied in the aqueous/CO system at 625° F./3300 psi versions and coal properties. At both temperatures, conversions to liquids + water + gas showed only minor changes over this range of times, while production of THF solubles was very dependent on reaction time. For the 625° F. cases, the rate of production of THF solubles appears to increase between 1 and 2 hours, and then slow somewhat between 2 and 4 hours. Between 2 and 4 hours the yield of THF solubles still increases significantly, from 38% to 57%. At 650° F. the rate of production of THF solubles is already decreasing between 1 and 2 hours, and between 2 and 4 hours only a small increase in THF solubles is observed. At 650° F. the oxygen content of the treated coal shows only small further decreases after 1 hour in aqueous/CO, while at 625° F. it is somewhat slower in leveling off. At both temperatures, volatile matter and H/C ratio are more dependent on reaction time.

The effect of the $H_2O$/coal and CO/coal ratios on conversions and coal properties were also studied over a range of temperatures. All of the data discussed earlier were obtained at $H_2O$/daf coal weight ratios of 3.3-3.7 and at CO/daf coal weight ratios of 0.65 (700 psi CO charge) and 0.84 (900 psi CO charge). These CO/daf coal weight ratios are equivalent on a molar basis to hydrogen treats of 4.6% and 6%, respectively. The $H_2O$/coal and CO/coal ratios were varied by changing the amounts of wet coal and water charged to the reactors in order to show the effects on conversion to THF solubles and on the H/C ratios of the treated coals to temperatures of 550, 600, and 650° F., all at 2 hour reaction times.

At 550° F. it is possible to cut the water/daf coal ratio in the aqueous system to 1/1 and to decrease the CO treat to a 3 wt% hydrogen equivalent without significantly affecting 550° F. conversion or treated coal properties. Further decreases in either water or CO do have adverse effects on the properties of the treated coal. At higher temperatures, although some reductions in water and CO levels are possible, neither can be cut back as far as in the 550° F. case without losing some of the effects of the aqueous treatment. At the higher temperatures, water-gas-shift converts more of the CO to $CO_2$. (Since thermodynamically, higher temperatures should favor CO over $CO_2$, this indicates that water-gas-shift is kinetically rather than thermodynamically controlled in these experiments. This is confirmed by calculations which show that in all of these cases, water-gas-shift is far from equilibrium.) This may partly explain the higher CO requirement at higher temperatures. In addition, more water is required at higher temperatures to maintain a sufficient volume of water in the reactor.

EXAMPLE 3

This example illustrates the increase in extractability observed for carbon monoxide pretreated coal versus non-pretreated coal, in THF (tetrahydrofuran) at low to moderate temperatures, and in a typical process-derived solvent at a temperature which might be encountered in a commercial process. In addition, this example highlights some of the benefits which extraction imparts to a liquefaction feed.

The feed coal for pretreatment in these experiments was a Wyoming sub-bituminous coal from the Rawhide mine, stored as mined in plastic-lined, sealed metal cans until just prior to use. Before pretreating, the coal was ground to −30 mesh as quickly as possible (to minimize loss of equilibrium moisture), and resealed in the metal can until used.

To determine the solubility of the non-pretreated coal in THF, approximately 1 gram of ground, dried coal was weighed into a 50 cc centrifuge tube, and extracted with THF as detailed in Example 1. Alternatively, the coal was weighed into a porous thimble, and soxhlet extracted with THF until the extracting solvent was nearly colorless. Over many different batches of coal, the room temperature (about 70° F.) procedure extracted from 5 to 9wt% on a daf (dry, ash free) basis. The soxhlet procedure, run at a temperature of about 140° F., gave slightly higher numbers, in the range of 8 to 15 wt% daf.

The pretreatment for these experiments was carried out in a 1 liter stainless steel stirred autoclave capable of high temperature and high pressure operation. Table 4 summarizes the run conditions, and the resulting pretreated coal solubility, for the four experiments discussed here.

TABLE 4

| | AP3-24 | AP18-58 | AP5-30 | AP25-2 |
|---|---|---|---|---|
| CO Treat, wt % dry coal | 42 | 42 | 42 | 60 |
| CO Pressure, psig | 900 | 900 | 900 | 900 |
| Water:Coal Ratio | 2:1 | 2:1 | 2:1 | 1.6:1 |
| Run Temperature, °F. | 600 | 600 | 600 | 600 |
| Residence Time | 3 hr. | 3 hr. | 4 hr. | 16 hrs. |
| THF Solution, wt % daf | 66.7 | 70.0 | 80.6 | 92.5 |
| Ash, wt % dry coal | 7.1 | 7.2 | 7.4 | — |

Runs AP3-24 and A18 were run under identical conditions, and the difference in THF solubilities is typical of the experimental variability observed. In runs AP5 and AP25, the residence time was increased to 4 and 16 hours, respectively, in order to gauge the dependence of solubility on residence time. These data demonstrate that an ultimate solubility of better than 90 wt% daf can be achieved primarily by increasing the residence time.

Since AP3 was the first experiment at 600° F. to yield a product with such high THF solubility, its solubility in a process-derived solvent, a distillate cut of coal liquids boiling between about 500 and 650° F., was tested by using a single step batch extraction. Approximately 1 gram of the ground and dried pretreated coal was weighed into a flask, and a 35-fold excess of process solvent was added. The mixture was stirred at 400° F. for 2 hours, and allowed to cool to 200° F. before filtering. The filter cake was allowed to cool to room temperature, and then rinsed with cyclohexane to remove residual process solvent. The residue was dried overnight in a vacuum oven, and then weighed to determine the weight of insolubles. Via this method, the solubility in the process solvent at 400° F. was determined to be 54.5 wt% daf. This batch experiment indicated that a commercial extraction might be practical, due to the depolymerization, and therefore increased solubility, of the coal afforded by the carbon monoxide pretreatment.

For runs AP18 and AP25, the solubilities in the process solvent were determined in a small flowthrough extractor. In this equipment, solvent is pumped at a known rate through a preheater and into a stationary bed of coal (from about 1 to 5 grams). The coal is held within a reactor tube contained in a vertical tube furnace with dual temperature controllers to maintain a constant, known temperature. A stainless steel frit at the bottom prevents backflow of coal particles, and the eluent stream is filtered at the top of the reactor tube by a 15 micron stainless steel mesh filter. At the end of an extraction run, the residue in the reactor tube and mesh filter is washed out with cyclohexane and collected via vacuum filtration on a tared piece of filter paper. The filter paper, reactor tube, and mesh filter are then dried overnight in a vacuum oven, and the total residue is taken as the combined net weights from the three items. In addition, the eluent can be collected and stripped of solvent to give a sample of the pretreated coal extract. Via this method, the solubilities of AP18 and AP25 product coals in the process solvent were found to be 58.8 and 89.8 wt% daf, respectively. In addition, in two extraction runs using AP25 product coal, the extract was tested via thermal gravimetric analysis, and determined to have ash levels of 800 ppm in one case, and 400 ppm for the other.

In order to generate sufficient quantities of the CO pretreated coal extract for further tests, the entire product from run AP30, 84.9 grams, was sequentially batch extracted three times using 1000, 500, and 500 ml of THF. In each case, the solution was heated, with stirring, to about 140° F. for 30 minutes, allowed to cool to room temperature, and then decanted through a Whatman #4 filter paper to catch any suspended particles. The solids on the filter paper were rinsed back into the flask, fresh solvent added, and the next batch extraction performed. After the final extraction, the residue in the flask was rinsed with fresh THF, and the flask plus filter papers dried overnight in a vacuum oven. By this method of extraction, the yield of residue was 26.45 wt%. In addition, the extract contained 1.85 wt% ash, yielding a daf extraction of 78.0 wt%.

As a measure of the ability of the extraction process to selectively isolate a hydrogen-rich fraction (H/C) were calculated from elemental analyses of the AP5-30 product coal, the THF extract, and the residue from the extraction. The H/C ratios were, respectively, 0.949, 0.973, and 0.770. The enrichment of the extract over the product coal seems minor, but this is a function of the high level of extraction. A comparison of the H/C ratio of the extract versus the residue clearly shows that the extraction separates the product coal into a hydrogen-rich, low-ash stream, and a hydrogen-depleted, ash-laden stream.

These results demonstrate that a very mild aqueous CO pretreatment can generate a product coal ideally suited to a subsequent extraction in a solvent which can economically be derived from the liquefaction step. These results further demonstrate the benefits of such an extraction in concentrating the feed coal ash into a hydrogen-poor residue stream which can be sent to a partial oxidation unit, while separating nearly all of the feed coal hydrocarbon into a soluble, very low ash, hydrogen-rich stream which can be sent to further upgrading.

EXAMPLE 4

This example illustrates the effect and advantages of extraction in connection with the hydroconversion of coal to liquids. Pretreated coal extract will be shown to exhibit much improved hydroconversion, and selectivity to liquid over gaseous product at lower hydrogen consumption, relative to whole (unextracted) pretreated coal and to unpretreated coal.

The liquefaction experiments were performed in minibomb reactors consisting of a 1 inch Swagelok cap and plug set which had a volume of 11.11 cc. Coal, solvent, molybdenum catalyst precursor and elemental sulfur (for sulfiding the catalyst in-situ and maintaining the sulfided state) were charged to a minibomb in the appropriate amounts, typically 1.0877 g, 1.0877 g, and 0.0014 g (500 ppm Mo on coal) and 0.0018 g, respectively, with the aid of a four place electronic balance. The coal was a Wyoming subbituminous coal, the coal-derived solvent had a nominal boiling range of 400–1000° F., and the catalyst precursor was molybdenum hexacarbonyl.

In the case of the coal extract AP5–30, made and isolated as described in Example 3 (see Table 4), no solvent was needed since it was known to melt (and serve as its own dispersal medium) at liquefaction conditions. Coals and coal extraction residue required solvent.

The loosely threaded minibomb was totally enclosed and sealed in a pressurizing cell. The cell and minibomb were evacuated with an in-house vacuum system to remove air, and overpressured with about 1320–1350 psi hydrogen. The pressure was let down to the target level of 1312 psi via a fine metering valve and followed with a pressure transducer with which the pressurizing cell was equipped. The cell was mounted in a vice, and an outside nut on the cell, connected to the minibomb inside via a pressure-tight shaft and socket within the cell, was turned so as to seal the pressurized minibomb. The weight percent hydrogen on coal, extract or residue was typically 6 wt%, achieved by charging the appropriate amounts of other reactants. As many as twelve minibombs could be run at once.

The minibombs were mounted on a rack and agitated at 250 cycles per minute for 3 hours in a heated, fluidized sandbath held at 840° F. The minibombs were not equipped with an internal thermocouple, but previous measurements indicated that less than 3 minutes is required to reach reaction temperature. After 3 hours, the minibombs were removed from the sandbath and cooled in air.

The total gas product was collected in the pressurizing cell, vented to an evacuated teflon-lined stainless steel gas bottle, and analyzed by mass spectroscopy. Liquid product from the coal extract was analyzed for boiling point composition by gas chromatographic distillation (GCD). The 1000° F.− liquid product plus water from unpretreated coal, pretreated coal, and pretreated coal extraction residue was defined by difference based on cyclohexane insolubles (see Maa et al., *Ind. Eno. Chem. Process Des. Dev.*, 23(2), 242 (1984)).

The conversion data for whole (unextracted) pretreated coal, pretreated coal extract AP5–30, and pretreated coal extraction residue AP5–30 are summarized in Table 5. It is seen that the extract makes less hydrocarbon gas than the whole coal or residue, and more liquid product, while consuming less hydrogen. This is consistent with the data of Example 3 showing that extraction concentrates the more hydrogen-enriched fraction of the pretreated coal.

The data for unpretreated coal in once-through conversion (i.e., the bottoms are not recycled to reap additional conversion benefits), unpretreated coal in recycle operation (i.e., bottoms are recycled for additional conversion), and pretreated coal extract in once-through conversion are presented in Table 6. Recycle operation was conducted in a semi-integrated flow unit operated at 840° F. in which the nominal residence time of the unconverted coal and bottoms is calculated to be three and one half hours. This was one half hour more than was given to the extract in once-through conversion.

It is seem from the data in Table 6 that the pretreated coal extract makes the least hydrocarbon gas and the most liquids, while consuming the least hydrogen. (The yield slate for pretreated coal extract sums to 101.8% because the extract converts nearly completely, and hydrogen consumption adds 3.9 wt% to the product weight.) It is noteworthy that the pretreated coal extract 650° F.− liquids would increase in recycle operation by recycle of the 650° F.+ fraction, and because the hydrogen treat used in recycle operation is normally 9 wt%, not the 6 wt% used in once-through operation.

In summary, the data in Tables 5 and 6 show that an extract of pretreated coal is considerably more reactive than either whole (unextracted) pretreated coal or untreated coal, even when the untreated coal bottoms are recycled for additional conversion. Further, the conversion of pretreated coal extract is achieved at higher selectivity to more valuable liquids over less valuable gas, and at lower hydrogen consumption. Still further, the pretreated coal extraction residue, which would typically be sent to a partial oxidation unit to generate process hydrogen and carbon monoxide, represents the least reactive, most hydrogen-lean, most ash-laden part of the coal.

TABLE 5

Hydroconversion of Wyoming Sub-Bituminous Coal: Whole Pretreated Coal, Pretreated Coal Extract AP5-30 and Pretreated Coal Extraction Residue AP5-30

| Yields (wt % daf) | Whole Pretreated Coal (Once-Through) | AP5-30 Pretreated Coal Extract (Once-Through) | AP5-30 Pretreated Coal Extraction Residue (Once-Through) |
|---|---|---|---|
| $CO_x$ | 2.4 | 1.9 | 5.4 |
| $C_1$-$C_4$ | 16.4 | 11.8 | 15.7 |
| Liquid Product (hydrocarbon + water) | 51.6 | 88.1 | 43.6 |
| Hydrogen Consumption | −4.7 | −3.9 | −4.9 |

TABLE 6

Hydroconversion of Wyoming Sub-Bituminous Coal: Once-Through with Unpretreated Coal, Recycle with Unpretreated Coal and Once-Through with Pretreated Coal Extract AP5-30

| Yields (wt % daf) | Unpretreated Coal (Once-Through) | Unpretreated Coal (Bottoms Recycle) | AP5-30 Pretreated Coal Extract (Once-Through) |
|---|---|---|---|
| $CO_x$ | 9.5 | ca. 8 | 1.9 |
| $C_1$-$C_4$ | 15.9 | 14.0 | 11.8 |
| Liquid Product (hydrocarbon + water) | 42.2 | 58.1 | 88.1 |
| + water | — | 14.5 | 5.1 |
| + $C_5$-350° F. | — | 12.1 | 23.8 |
| + 350–650° F | — | 29.7 | 38.6 |
| + 650–1000° F. | — | 1.8 | 20.7 |
| Hydrogen Consumption | −4.7 | −5.3 | −3.9 |

It will be understood that while there have been herein described certain specific embodiments of the invention, it is not intended thereby to have it limited to or circumscribed by the details given, in view of the fact that the invention is susceptible to various modifications and changes which came within the spirit of the disclosure and the scope of the appended claims.

What is claimed is:

1. A process for hydroconverting coal to produce a carbonaceous liquid, which comprises:

a) forming a mixture comprising coal particles, carbon monoxide and water in a pretreatment zone and heating said mixture to a temperature within the range of about 550° to 700° F. and under a system pressure of at least about 1800 psi for a period of time sufficient to cause an increase in the solubility of the coal in organic solvent, the weight ratio of liquid water to coal present during said heating stage being at least about 0.5:1;

b) extracting the pretreated coal with an organic solvent in an extraction zone to obtain from said coal an extract, comprising a substantial amount of soluble hydrocarbonaceous materials, and a residue comprising substantially all of the inorganic ash;

c) forming a mixture comprising said extract and a catalyst, wherein the catalyst is comprised of dispersed particles of a sulfided metal containing compound, said metal being selected from the group consisting of Groups VA, VIA, VIIA and VIIIA of the Periodic Table of Elements and mixtures thereof; and d) reacting the mixture of coal extract and catalyst with a hydrogen-containing gas under coal hydroconversion conditions, in a hydroconversion zone to obtain a hydrocarbonaceous liquid.

2. The process of claim 1, wherein the pretreating of step (a) and extracting of step (b) occur simultaneously by mixing coal, carbon monoxide, water, and an organic solvent in said pretreatment zone.

3. The process of claim 1, wherein the pretreating of step (a) and the extracting of step (b) are performed sequentially in separate pretreatment and extraction zones.

4. The process of claim 1, wherein said extract and residue are both reacted in a hydroconversion zone.

5. The process of claim 1, wherein said hydroconversion is at a temperature of 650 to 950° F.

6. The process of claim 1, wherein the hydroconversion is at a temperature between about 650 and 800° F.

7. The process of claim 1, wherein said pretreatment is at a temperature of 600 to 675° F.

8. The process of claim 1, wherein said pretreatment is at a temperature of 600 to 650° F.

9. The process of claim 1, wherein said catalyst is a conversion product of an organic oil-soluble metal compound.

10. The process of claim 1, wherein said supported catalyst particles have an average diameter of 0.02 to 2 micron.

11. The process of claim 1, wherein said compound is molybdenum sulfide.

12. The process of claim 1, wherein the hydrocarbonaceous liquid is fractionated to obtain a liquid product and a solvent.

13. The process of claim 1, wherein the extract of step (b) is separated from a residue comprising ash-containing coal solids by filtration, sedimentation, cycloning, centrifugation, or settling.

14. The process of claim 13, wherein the residue is subjected to partial oxidation, whereby carbon monoxide for step (a) is produced and hydrogen for step (d) is produced.

15. The process of claim 14, wherein a portion of the pretreated coal bypasses step (b) and is subjected to partial oxidation.

16. The process of claim 1, wherein in a separation zone following step (a), gases and water are removed from the pretreated coal mixture.

17. The process of claim 1, wherein the coal effluent product from the hydroconversion zone comprises an oil product and a gaseous mixture comprising hydrogen, and wherein, in a separation zone, the gases are removed overhead and thereafter recycled to the hydroconversion zone.

18. The process of claim 1, wherein the coal residue from step (b) is less than 30% by weight of the pretreated coal on a daf basis.

19. The process of claim 1, wherein following step (a) water is separated from said mixture by settling, centrifuging or filtering.

20. The process of claim 1, wherein following step (a) the water is removed from the coal by a gravity belt filter press.

21. The process of claim 1, further comprising introducing the hydrocarbonaceous liquid produced in step (d) into a fractionation zone, wherein at least two fractions are obtained.

22. The process of claim 1, wherein water is recycled to the pretreatment zone.

23. The process of claim 1, wherein the coal in step (a) is raw pulverized coal.

24. The process of claim 1 wherein the solvent is separated by distillation from the extract of step (b) prior to hydroconversion and recycled to the extraction zone.

25. The process of claim 1, wherein the catalyst is recycled to the hydroconversion zone.

26. The process of claim 1, wherein the organic solvent of step (b) comprises a process derived fluid.

27. The process of claim 26, wherein the organic solvent is derived from hydroconversion step (d).

28. The process of claim 26, wherein the solvent is a distillate boiling in the range of about 400 to 650° F. or a vacuum gas oil boiling in the range of about 650 to 1000° F. or a combination thereof

29. The process of claim 1, wherein the solvent of step (b) is selected from the group consisting of hexane, benzene, isopropanol, dichloromethane, acetone, tetrahydrofuran, or pyridine.

30. The process of claim 1, wherein the solvent of step (b) is derived from coal, shale, petroleum or bitumen.

31. The process of claim 1, wherein an organic solvent is introduced into the pretreatment zone in step (a).

32. The process of claim 1, wherein the total system pressure is about 800 to 4500 psi.

33. The process of claim 1, wherein the residence time in the pretreatment zone is about 20 minutes to 2 hours.

34. The process of claim 1, wherein the coal is sub-bituminous, lignite, brown, or peat.

35. The process of claim 34, wherein the coal is a sub-bituminous coal.

36. The process of claim 1, wherein said catalyst in step (c) is added in an amount ranging from about 10 to less than 5000 weight parts per million, calculated as the elemental metal, based on the weight of the coal extract in said mixture.

37. The process of claim 9, wherein said oil soluble metal compound is selected from the group consisting of inorganic compounds, salts of organic acids, organometallic compounds and salts of organic amines.

38. The process of claim 37 wherein said oil soluble metal compound is selected from the group consisting of salts of acyclic aliphatic carboxylic acids and salts of alicyclic aliphatic carboxylic acids.

39. The process of claim 38 wherein said oil soluble metal compound is a salt of naphthenic acid.

40. The process of claim 9 wherein the metal constituent of said oil soluble metal compound is selected from the group consisting of molybdenum, chromium and vanadium.

41. The process of claim 37 wherein said oil soluble metal compound is molybdenum naphthenate.

42. The process of claim 37 wherein said oil soluble metal compound is phosphomolybdic acid.

43. The process of claim 1, wherein said hydrogen containing gas of step (d) comprises from about 1 to 10 mole % hydrogen sulfide.

44. The process of claim 1, wherein said hydrogen-containing gas of step (d) comprises from about 1 to 5 mole % hydrogen sulfide.

45. The process of claim 9, wherein said oil soluble metal compound is converted to a catalyst by first heating a mixture of said soluble metal compound, coal and solvent to the temperature ranging from about 600 to about 840° C. in the presence of hydrogen-containing gas to form a catalyst within said mixture and subsequently reacting the resulting mixture containing the catalyst with hydrogen under coal hydroconversion conditions.

46. The process of claim 9, wherein said oil soluble metal compound is converted in the presence of a hydrogen-containing gas in the hydroconversion zone under hydroconversion conditions, thereby forming said catalyst in-situ within said mixture in said hydroconversion zone.

47. The process of claim 1, wherein said hydroconversion conditions in step,(d) further include a hydrogen partial pressure ranging from 500 to 5000 psig.

48. The process of claim 1, wherein the space velocity of said mixture in said hydroconversion zone ranges from about 0.1 to 10 volumes of mixture per hour per volume of hydroconversion zone.

49. The process of claim 1, wherein said solvent and coal extract are mixed in step (b) in a solvent-to-coal extract weight ratio ranging from about 0.8:1 to about 4:1.

50. The process of claim 1, wherein said solvent and coal extract are mixed in step (b) in a solvent-to-coal extract weight ratio ranging from about 1:1 to 2:1.

51. The process of claim 1, wherein said solvent in step (b) comprises a compound or a mixture of compounds having an atmospheric boiling point ranging from about 650° F. to less than about 1000° F.

52. The process of claim 1 wherein the weight ratio of liquid water to coal ranges from about 0.5:1 up to about 2:1.

53. The process of claim 1 wherein said carbon monoxide is present at a level of from about 40 to 100% by weight based on the weight of dry coal.

* * * * *